US005356238A

United States Patent [19]

Musil et al.

[11] Patent Number: 5,356,238

[45] Date of Patent: Oct. 18, 1994

[54] PAVER WITH MATERIAL SUPPLY AND MAT GRADE AND SLOPE QUALITY CONTROL APPARATUS AND METHOD

[75] Inventors: Joseph E. Musil, Ely; Charles G. Macku, Cedar Rapids, both of Iowa

[73] Assignee: Cedarapids, Inc., Cedar Rapids, Iowa

[21] Appl. No.: 28,995

[22] Filed: Mar. 10, 1993

[51] Int. Cl.[5] ..... E01C 19/00

[52] U.S. Cl. ..... 404/84.1; 404/101

[58] Field of Search ..... 404/84.05, 84.1, 84.2, 404/84.5, 84.8, 96

[56] References Cited

U.S. PATENT DOCUMENTS

| | | | |
|---|---|---|---|
| 3,158,945 | 12/1964 | Curlett et al. . | |
| 3,264,958 | 8/1966 | Babb et al. | 404/84.1 |
| 3,264,959 | 8/1966 | Shea | 404/84.1 |
| 3,285,148 | 11/1966 | Munyon . | |
| 3,453,939 | 7/1969 | Pollitz . | |
| 3,700,288 | 10/1972 | Davin et al. . | |
| 3,811,787 | 5/1974 | Beaty et al. . | |
| 3,813,181 | 5/1974 | Barnes, III . | |
| 3,872,601 | 3/1975 | Burgin | 404/84.1 X |
| 3,967,912 | 7/1976 | Parker . | |
| 4,213,719 | 7/1980 | Swisher, Jr. . | |
| 4,403,889 | 9/1983 | Gillotti . | |
| 4,423,360 | 12/1983 | Pasterkamp . | |
| 4,682,908 | 7/1987 | Domenighetti . | |
| 4,702,642 | 10/1987 | Musil . | |
| 4,750,584 | 6/1988 | Tanaka et al. . | |
| 4,793,434 | 12/1988 | Bachle . | |
| 4,801,218 | 1/1989 | Musil . | |
| 4,823,366 | 4/1989 | Williams . | |
| 4,925,340 | 5/1990 | Heiser et al. . | |
| 4,933,853 | 6/1990 | Musil et al. . | |
| 4,961,173 | 10/1990 | Sehr et al. . | |

OTHER PUBLICATIONS

"NFT 550A", Asphalt Finisher, Niigatta Engineering, May 1986.

"Grayhound CR551 Hot Mix Paver", Bulletin CR551-Sep. 1991, 1991, Cedarapids, Inc.

"Quality Paving Guide Book", 19705 (Jan. 1992), Cedarapids, Inc.

*Primary Examiner*—Ramon S. Britts

*Assistant Examiner*—James A. Lisehora

*Attorney, Agent, or Firm*—Simmons, Perrine Albright & Ellwood

[57] ABSTRACT

An asphalt paver includes a microprocessor controlled integrated control system to control both the operation of a tractor unit of the paver and the positioning of the screed during a paving operation. A paver operator may operate the paver and monitor the screed position with respect to a grade reference. The correction of grade or transverse slope errors is accomplished by monitoring the linear advance of the paver and then measuring a any deviation of the screed with respect to a grade reference. The amount of vertical deviation and the linear advance since a most recent correct reading allows a rate of deviation per unit advance of the paver to be determined. A correction is applied as a change in the angle of attack of the screed, the change being equal and opposite to the determined rate of deviation. A transverse slope change is also measured directly at the screed. A measured transverse angular deviation is translated into a vertical deviation which is then translated into a rate of deviation per unit advance of the paver with a corrective twist being applied to the screen to offset the deviation. Advantageously dual grade sensors and dual slope sensors are contemplated to provide an automated microprocessor controlled grade and slope control in accordance herewith.

20 Claims, 10 Drawing Sheets

PAVER WITH MATERIAL SUPPLY AND MAT GRADE AND SLOPE QUALITY CONTROL APPARATUS AND METHOD

BACKGROUND OF THE INVENTION

1. Field of the Invention

This invention relates generally to paving machines and more particularly to apparatus for and methods of controlling the operation of such paving machines.

2. Discussion of the Related Art

Asphalt pavers for laying mats of asphaltic materials on roadways, parking lots or the like are well known in the art. A state of the art asphalt paver is a self-propelled unit capable of advancing along a designated course having a prepared base surface, and of depositing a paved layer of asphaltic material to a specified thickness, grade and slope on such base surface. The asphalt paver spreads and compacts asphaltic materials into a paved strip or mat of a certain width and thickness, and of an initial degree of compaction. After the paver establishes the desired slope and grade of the paved mat during the initial paving operation, the compaction of the paved material might typically be completed during a subsequent finishing operation with a compaction roller.

Smoothness and correspondence to specified grades and slopes of the paved mat are major considerations in assessing the quality of the paved mat as a product of an asphalt paving machine. Uniformity of compaction or consistency of the paved mat has a direct effect on the durability or ability of the paved mat to retain its specified grade and slope over time. Uniformity of compaction is consequently considered to be an inherent quality element of the paved mat as the final product. Lack of uniformity of compaction in the mat as it is laid down by a paver may result in surface waviness after final compaction of the mat by a vibratory roller, for example. Other defects in the paved mat may be caused by momentary lack or short supply of paving material which may cause surface voids to occur in an otherwise smooth mat. Stops or changes in paving speeds of the paver may also result in defects such as linear ridges or discontinuities in the surface transverse to the longitudinal extent of the paved mat.

Grade and slope of paved mats are determined by the height and transverse inclination of the trailing edge of a floating vibratory screed of the paver which is pulled along by and behind the tractor unit of the paver. The amount of paving material deposited under and compacted by the floating screed determines the final height and transverse slope of the screed and, hence, of the paved strip. The grade and slope control over the paved mat is exercised by changing the angle of attack of the lower, compacting surface of the screed with respect to its forward direction of travel, and by supplying a uniform amount of material at the leading edge of the screed. The angle of attack of the screed may be controlled by the angle of a pull arm on each side of the screed, in addition to an adjustable setting at the screed itself. The pull arms of the screed may be adjusted vertically independently of each other. The pull arms are moved jointly up or down to correct for errors in the grade of the pavement. Depending on the density or, conversely, the compactability of the material at the leading edge of the screed, the angle of attack of the screed may need to be changed to account for variations in material compression resulting from the vibratory paving or compacting action of the screed over the distance of its width in the direction of travel of the paver.

The lengths of the pull arms from the screed to a forward adjustment point, generally near the pull point by which the pull arms are coupled to the tractor unit of the paver, determine the precision with which an adjustment to the angle of attack or orientation of the screed can be made. Sensing any deviation of the pull arm from a desired grade at such forward position gives a recognition of any error at the forward position, but does not define the actual position of the screed. Sensing the actual position of the screed at the leading edge of the screed to correct positioning errors has been found to lead to a possible over-correction of errors in the screed angle of attack or angle of float. Such over-correction of minor deviations has resulted in oscillating paving thicknesses, and, hence, in unacceptable waviness of the paved strips laid down by the paver.

Similarly sensing the actual transverse slope of the screed at the screed and comparing it to a specified slope to generate a corrective control signal is known to cause overcontrol. Typical transverse slope controls are mounted across the pull arms of the screed just forward of the screed. The slope indicated by a single slope sensor mounted ahead of the screed is known, however, to introduce an error which reduces the accuracy of control over the screed slope. U.S. Pat. No. 4,925,340 shows a transverse slope control with dual slope sensors. A first slope sensor is located directly at the screed and senses the transverse slope of the screed. A second slope sensor is mounted across the screed pull arms and senses a slope across the left and right pull arms of a paver. Since a slope measured by the second sensor does not under all conditions accurately reflect the angular difference position of the pull arms, errors may be introduced into a control signal without knowing the actual skew or twist in the screed that may have been introduced by a corrective repositioning of the pull arms.

Various development efforts, over the years, have resulted in improvements pertaining to controlling the quality of the laid down pavements. U.S. Pat. No. 4,933,853 discloses an ultrasonic ranging transducer marketed by Polaroid. Such a transducer working with a Texas Instruments ranging module may be used as a digital distance measuring sensor. Having measured a vertical distance from the sensor to a grade reference, a control signal may be generated to control an angle of attack of a screed of a paver. Known slope controls permit an operator to set or simply dial in a specified percentage of transverse slope. The positioning of the slope control with respect to the screed may be critical as is the positioning of the grade sensor. Positioning the slope control directly on the screed has in the past been found to result in instability of control. The dual slope control shown in U.S. Pat. No. 4,925,340 uses an algorithm to interrelate signals from the two slope sensors, one being located directly on the screed of a paver and a second sensor at an intermediate position along the pull arms. An error signal of the slope of the screed is apparently integrated over a distance travelled by the paver and is further modified by adding the negative value of the slope signal of the intermediate sensor to arrive at a correction signal.

A banking slope in paving a curve is typically paved by requiring an operator to change the amount of slope at particular positions into and out of the curve to provide for an orderly increase of bank going into the curve and for an orderly decrease of bank going out of the curve into a subsequent straight stretch of pavement. A screed man may typically control and monitor the operation of the screed and correctness of any bank or slope of the paved strip separately of a paver operator. Though it may be desirable that an operator of the paver controls both the paver advance and the operation of the screed, a sole operator generally could not control the slope and grade and also steer the paver along the intended track of the curve and to maintain the correct grade of the pavement. However, even if two operators are used to separately control the paver and the screed, it is readily apparent, the operation of a typical state of the art asphalt paver is nevertheless complex and requires continuous attention to several process variables in order to produce a pavement of acceptable quality. Improvements in the control of asphalt paver operations are desirable to reduce margins of error, to increase reliability of operations and thereby reduce the cost of paving, and to produce pavements of highest possible quality.

SUMMARY OF THE INVENTION

It is an object of the invention to provide a self-propelled paver with interactive controls for supplying paving material to a screed of the paver, for distributing the paving material along the screed, for monitoring the grade and cross slope of the screed and for controlling the grade and the cross slope based on the speed of the paver, the material supply and the orientation and position of the screed.

It is another object of the invention to provide a self-propelled paver with an arrangement for automatically changing an existing cross slope of a paved mat being laid according to a predetermined profile related to a longitudinal advance of the paver.

It is a further object of the invention to provide an arrangement for determining instantaneous and cumulative read-outs of material through-put or flow rates of paving material through the paver.

It is yet another object of the invention to control the surface quality of a laid mat of pavement by multiple position and orientation sensors disposed on the screed or the pull arms.

A further object of the invention is to provide travel distance sensors which provide position signals which define the position and the orientation of the screed with respect to predetermined pavement grade and cross slope requirements.

Another object of the invention is to provide a paving material supply reserve indication to manage a rate of paving with respect to available material.

Yet another object of the invention is to provide an arrangement for correlating speed and grade controls to compensate for pavement mat thickness variations as a result of paving speed variations.

It is a further object of the invention to distribute driving forces to prevent slip of wheels of a paver.

The invention is particularly applicable to and improves a known asphalt paver of a type including a tractor unit and a vibrating or compacting screed which is pulled along a course by left and right pull arms coupled to the tractor unit. The improvement comprises an integrated control system which correlates the operation of the elements of the paver which supply and distribute paving materials to the screed with those that which correct positioning errors of the screed with respect to a specified grade and slope along the course. The integrated control system includes provisions for offsetting inherent mat thickness changes due to speed changes by controlling other operational elements to counteract the anticipated thickness change. A speed change may be coupled to a change in the orientation of the screed and in the rate of material supply to substantially maintain a prescribed grade and slope of the paved mat.

According to the invention, the control system includes a device for controlling the supply of paving material, a device for controlling the distribution of paving material transverse to the paving direction along the screed based on multiple material sensors. The control system further includes a device which measures distance travelled by the paver for monitoring the distance travelled, hence, the position of the paver along a measured course, as well as the rate at which the paver advances.

According to a particular feature of the invention, first and second grade sensors, one adjacent the pull point and the second at the screed, determine the vertical position of the pull arms and any displacement resulting from vertical error in the base surface and determine the vertical position of the screed with respect to the desired grade, respectively. The first and second sensors may be disposed on either side of the paver, or on both sides when a strip of pavement is laid using dual grade references.

A slope sensor, located at the screed, monitors the cross slope of the screed and pavement, referred to as the slope. An arrangement is provided to compare the slope of the screed and, hence, that of the paved mat to a specified reference slope. The arrangement includes a provision for determining a magnitude of a corrective action on the screed, in response to a detected deviation from the slope, to be applied through first and second pull arms, and a provision for applying and monitoring the application of the correction.

The control system includes a provision for storing and recalling predetermined paving parameters to control the screed orientation and material flow based on the current position of the paver along the measured course or route of a strip of pavement to be paved.

According to a particular feature of the invention, a material flow rate from a material supply hopper to the screed is monitored and is controlled, based on material demand ahead of the screed as determined by a measurement at inboard and outboard points of a transverse distribution conveyor disposed ahead of the leading edge of the screed.

Advantages of the invention and of particular features set forth herein include the integration of input signals from various sensors to generate control signals to automatically adjust the operation of material feed and material distribution to the screed, the screed angle of attack, the speed of advance of the paver or any combination of operation elements as may be needed to maintain grade, slope and material quality of a paved mat.

Other advantages of certain features which may operate in accordance with the invention may include such interlocking paver features, as speed dependent speed range blocks, and an engine starter blocking arrangement which becomes active when the engine is running.

Various other advantages and features of the invention will become apparent from the detailed description of the invention and a preferred embodiment thereof.

CONSIDERATIONS RELATED TO THE INVENTION

Various devices are available to measure deviations of a vibratory screed of a paving machine from a desired grade or cross slope. In response to measurements, the screed is positioned. The positioning of the vibratory screed of a paver and the control of the screed to maintain its position along the path of the paver is critical to the success of the paving operation. After all, the trailing edge of the screed bottom rides on and determines the grade and slope of the strip of pavement that has just been laid down by the paver. The position of the screed is typically monitored to determine its conformance in slope and grade to given specifications. Deviations from the specified grade and slope need to be corrected. At the same time, waviness of the pavement over a measured length of the paved strip is often also of concern since it affects the smoothness with which a vehicle will travel along the pavement. Many paving specifications set forth a standard of smoothness which is measured in inch-bumps per mile to which the laid down pavement needs to conform. Thus, any abrupt or excessive correction of a deviation from a specified grade may generate in itself a defect by creating a change in the grade which is measurable in terms of the inch-bump per mile parameter.

A steady orientation of the pull arms of the screed with respect to the surface to be paved is generally understood to be critical to achieving a conforming and substantially smooth pavement. The position of the grade and slope sensors along the arms are also understood to be critical to the ability of the screed to lay down pavement pursuant to specifications. A grade or slope sensor positioned at or directly adjacent the screed tends to measure the actual position or orientation of the screed with respect to the specified position or orientation. On the other hand, deviation corrections generated by such a sensor have been found to overcorrect errors, since the screed itself lags in response to a corrective positioning of the pull arms of the screed. Sensors disposed at the screed tend to generate waviness in the pavement, though a relatively quick correction of deviations is achievable.

Grade or slope sensors that are positioned toward the front end of the pull arms tend to generate a smooth riding surface, though changes in material composition, in temperature or in other variables may actually cause the screed to deviate from a specified slope. Forwardly located sensors cause the pull arms to follow the specified slope and grade, while the free floating screed must then be assumed to asymptotically align itself and follow the front end of the pull arms and their alignment to the specified grade and slope. Though such an assumption is not unreasonable, according to state of the art practices grade or slope sensors are desirably attached intermediate of the screed and the front end of the pull arms, particularly somewhat forward of the screed. At the intermediate position along the pull arms, sensed deviations may be the result of a deviation of the front end of the pull arms because of an irregularity in the base grade which affects the tractor unit of the paver. On the other hand, the sensed deviation may indicate an error position of the screed with respect to a specified grade. The intermediate positions of the sensors consequently temper an abruptness of corrective action while still being responsive to a deviation of the screed from a specified grade or slope. However, because of their intermediate position, the sensors also fail to positively measure the screed position with respect to the grade.

The apparatus according to the invention measures and establishes the magnitude of deviation of the screed with respect to distance travelled by the screed. A rate of change of any deviation with respect to distance of the screed is, hence, determined as an angle of change. This angle or rate of change may be counteracted by an adjustment of the screed of an equal and opposite angle of correction to cancel any further increase in the deviation. Depending on the magnitude of the deviation, a rate of return from the value of deviation to the correct grade or slope is also established and is added to the initial counteracting correction.

Grade control advantageously may be implemented by dual, front and rear, grade sensors, one at the screed and one adjacent the front of the arm. The front sensor measures a vertical repositioning of the front of the arm with respect to a specified grade, such as a grade line or an adjacent, existing pavement surface. The rear sensor measures the actual position of the screed with respect to the specified grade. The front sensor may immediately correct for a deviation of the front of the respective pull arm from the specified grade reference when the paver drops or rises vertically because of an unevenness in the base grade. A deviation from the specified grade of the rear sensor indicates a paving error. Such an error is preferably immediately counteracted to offset a further increase in any deviation and to correct the error in a manner to avoid vertical bumps in the pavement. Depending on whether a pavement specification requires close adherence to the specified grade level or establishes a requirement of smoothness of the paved surface, the screed sensor is monitored while the front end of one or both pull arms are vertically adjusted to stop any deviation from increasing. In addition a "return to the specified grade level" correction is applied to the pull arms. Any deviation of the front pull arm sensor from the specified grade and the measured deviation of the screed sensor may be apportioned to establish a desired correction factor.

BRIEF DESCRIPTION OF THE DRAWINGS

The Detailed Description below may be best understood when read in reference to the accompanying drawings wherein.

DETAILED DESCRIPTION OF THE INVENTION

1. The Apparatus in General

Figure 1:
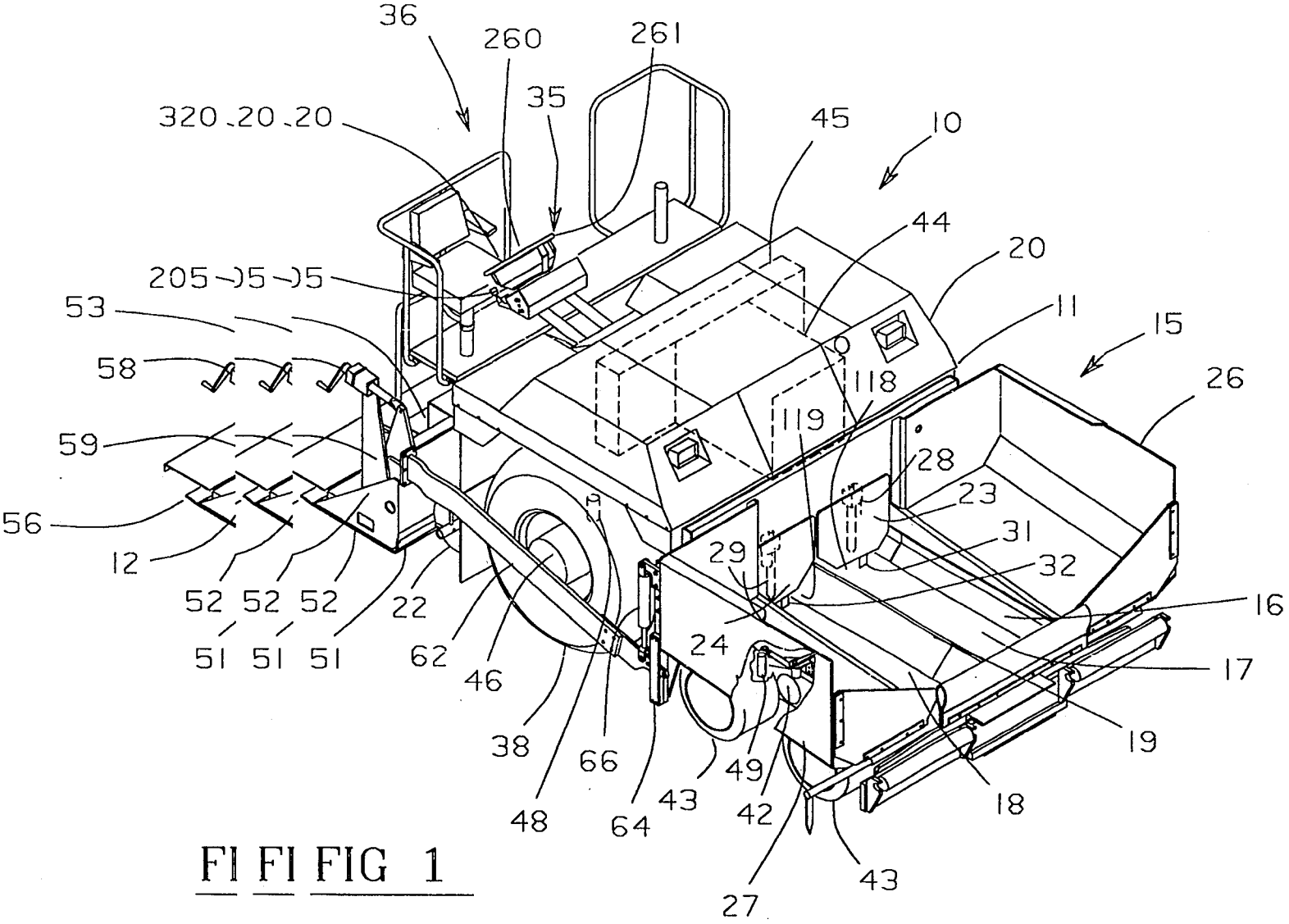
FIG. 1 is a simplified pictorial representation of an asphalt paving machine which depicts certain features of the invention.

FIG. 1 shows an asphalt paving apparatus or paver which is designated generally by the numeral 10. The paver 10 is a paving system which includes subsystems, such as a tractor unit 11 and a vibratory paving screed 12. Generally the vibratory paving screed 12 would include such elements as a vibrator unit, heater units which heat the paving surface of the screed to a predetermined temperature, and mechanical features to raise a central portion of the screed 12 for paving a "crowned" pavement. These features are well known in the art and are not separately described in great detail. The tractor unit, in addition to pulling the screed 12, supports a material receiving and distribution system or subsystem, designated generally by the numeral 15. The material receiving and distribution system 15 receives, temporarily retains and controllably distributes paving material to the screed 12. A material receiving hopper 16 is disposed at the front of the paver 10. The hopper 16 receives material from either a truck or by means of some other loading device. The hopper 16 is capable of storing a limited amount of material to meet fluctuations in material supply, such as are created when paving materials are supplied in batch deliveries by trucks.

Left and right slat conveyors 17 and 18 typically transfer material from a base 19 of the hopper 16 in the longitudinal direction of travel of the paver 10 toward the rear of the paver. The paving material passes centrally beneath a motor unit 20 of the paver 10. Left and right auger conveyors 21 and 22 (see FIG. 6) distribute paving material in front of the vibrating screed 12. According to current practice the speed of the left or right slat conveyors 17 or 18 is preferably coupled directly to the speed of the respective left or right auger conveyors 21 or 22.

The flow of material from the hopper 16 toward the screed 12 is controlled by left and right vertically adjustable flow gates 23 and 24. Because a common drive or gear box 25 couples the speed of the left slat conveyor 17 to the speed of the left auger conveyor 21, and couples correspondingly the speeds of the right slat conveyor 18 and the right auger conveyor 22 to each other, material distribution may proceed on one side of the paver 10 at a different rate from that on the other. Left and right hopper wings 26 and 27 may be used to transfer some of the paving material from one side of the hopper 16 to the other to equalize unequal material usage, should it occur. The hopper wings 26 and 27 tilt upwards toward the center of the hopper 16. Raising the wings 26 and 27 channels laterally deposited material onto the conveyors 17 and 18. By selectively raising one of the hopper wings but not the other, some of the material from the respective, raised hopper wing may be transferred to the other side of the hopper 16. The wings consequently increase the capacity of usable material of the hopper 16 and permit the transfer of material from one side of the hopper to the other. Left and right vertical positioning screws drives 28 and 29 control the height of the flow gates 23 and 24, respectively. The height of the gates 23 and 24 controls the volume of material per linear foot on each of the respective conveyors 17 and 18. Left and right alarm switches 31 and 32 signal an absence or insufficient height of material on either of the respective conveyors 17 and 18.

The operation of the paver 10 is controlled via an operator's console 35 from an operator's station 36 which is located at the rear of the tractor unit 11. FIG. 1 shows the tractor unit 11 as a wheeled unit. The tractor unit features main driving wheels 37 and 38, only wheel 38 being shown in FIG. 1. Even though the invention is described with respect to wheeled paver 10, it is to be understood that various features of the described invention will be applicable to both pavers driven by wheels and pavers propelled on endless tracks. The front end of the tractor 11 with the hopper 16 is supported by left and right pivotal tandem wheel assemblies 41 and 42, respectively, only the right assembly 42 being shown in FIG. 1. At least one wheel 43 of the tandem wheel assemblies may be powered, in addition to the main driving wheels 37 and 38. An internal combustion engine 44, preferably a diesel engine 44 powers a hydraulic power and drive system 45 and is located and part of the motor unit 20 in the central portion of the tractor unit 11. A separate hydraulic drive motor 46 is disposed at each of the powered wheels. The drive motors 46 are coupled to and are considered part of the hydraulic system 45. The hydraulic system 45 is also used in operating the suspension of the tractor 11 as well as other positioning devices including that of the screed 12.

Each of the main drive wheels 37, 38 is provided with a motion pickup device 48 to sense movement of the main wheels 37 and 38. In a preferred embodiment the motion sensor is a magnetic pickup device 48 which is mounted adjacent a gear of the main drive wheels 37 and 38. The magnetic sensing action of the pickup device 48 senses the passage of teeth of the adjacent gear (not shown) in a known manner and produces electrical pulses which are processed and counted as a sequence of signals within the operator's console 35. A known relationship of linear advance of the paver unit 10 and the count of electrical pulses from the pickup device 48 per revolution of the main wheels 37 and 38 is translated into a quantitative signal corresponding to the linear advance of the paver 10 during any given time interval. As a practical matter, the linear speed and the distance travelled of the paver 10 during any given time interval are determined from the reading of the magnetic pickups 48 at each of the main wheels 37 and 38.

The described distance and speed determining arrangement is also applicable to tractor units which are propelled by tracks as a "crawler" instead of by the described wheel drive. When the tractor unit 11 is a wheeled unit and one of the front wheels 43 is driven as described, the driven front wheel 43 is also powered by a further one of the hydraulic motors 46 in the hydraulic system 45. A further magnetic pickup 49 is mounted adjacent a corresponding gear on the respective motor 46 of the front wheel 43. The magnetic pickup 49 senses the teeth of the gear and generates a sequence of pulsed signals in response to rotation of the front wheels 43 in the same manner as that associated with each of the main wheels 37 and 38. Pulsed signals from the driven front wheels 43 are used to determine slip of the front wheels 43 rather than to measure the distance traversed by the paver 10. The front wheels 43 which are of smaller diameter than the main drive wheels 37 and 38 tend to slip when too much driving power is transferred to their respective motors 46. If because of such excessive power application, and slippery conditions of a base grade, the front wheels 43 start to spin, the magnetic pickup 49 senses an increased travel with respect to the paver advance sensed by the magnetic pickup sensors 48 at main wheels. The driving power may then be reduced sufficiently to arrest the wheel slippage. A similar slip or spin detector is, of course, not needed when the tractor unit 11 is a tracked crawler unit instead of a wheeled unit. The magnetic pickup sensors 48 and 49 are presently preferred devices for sensing wheel rotation as described. It should be understood that other than the magnetic pickup angular displacement indicators are known and commercially available. Optical indicators, for example, provide an even more precise angular displacement indication than the magnetic pickup sensors referred to herein. Any suitable device for generating a substantially accurate measurement of wheel rotation to be converted into advance and rate of advance of the paver 10 may be used in accordance herewith.

Further in reference to FIG. 1, the vibratory screed 12 is that element of the paver 10 which performs the actual paving function. The screed 12 is a "floating" screed which rides over the paving material fed under a leading edge 51 thereof. Vibratory motion of a bottom surface 52 of the screed is generated by a known eccentric vibratory apparatus shown schematically at 53. A trailing edge 56 of the screed essentially defines the grade of a paved strip of material produced by the screed 12.

The bottom surface 52 of the screed floats over the paving material at a slight angle of attack, the front edge 51 of the screed being higher than the trailing edge 56 when the screed height is balanced to lay a mat of material of a specified thickness. The initial angle of attack of the screed may be set by a crank or lead screw mechanism 58 disposed on each side of the screed 12. The lead screw mechanism 58 adjusts the bottom surface 52 with respect to a frame 59 of the screed 12. Left and right pull arms 61 and 62, only pull arm 62 being shown in FIG. 1, are attached to and extend forward from the frame 59. Once the angle of attack is set to an initial setting by the lead screw mechanism 58, the angle of attack of the screed 12 may be controlled throughout a paving operation by controlling the orientation of the pull arms 61 and 62 relative to a grade or slope reference. Front ends of the pull arms 61 and 62 are mounted in respective pull brackets 63 and 64 which permit vertical sliding motion of the pull arms with respect to the tractor unit 11. A controlled operation of hydraulic cylinders 65 and 66 establishes and controls vertical positioning of the respective pull arms 61 and 62 with respect to the tractor unit 11.

2. Operation of a Paver Screed Control

Figure 2:
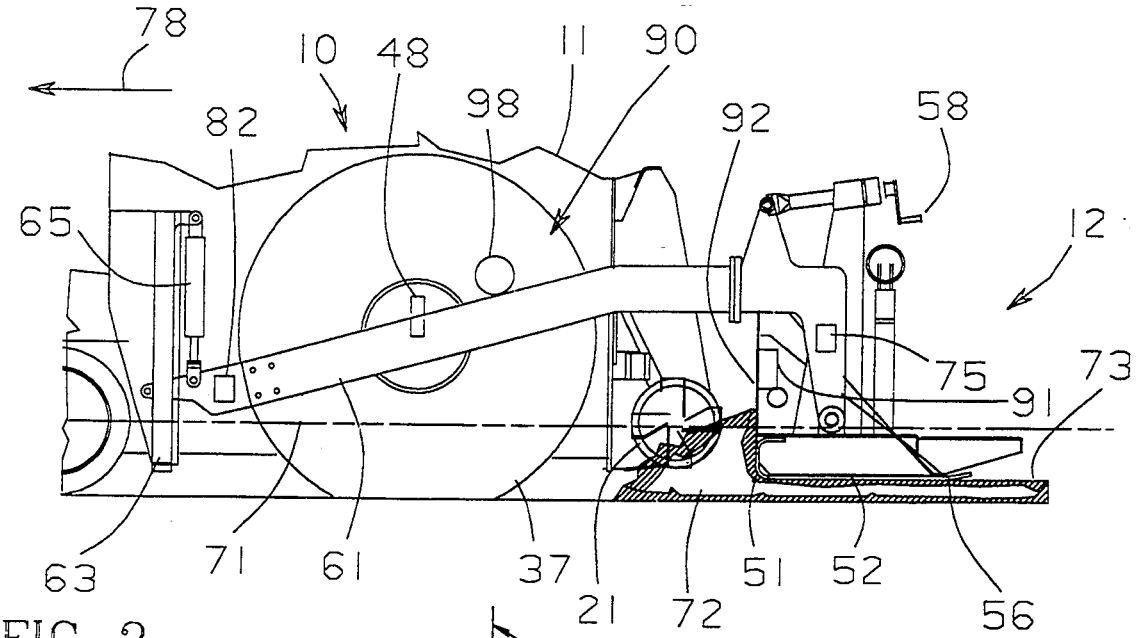
FIG. 2 is a schematic partial side elevation of a paver showing preferred grade and transverse slope sensor positions in accordance with the invention.

Referring to FIG. 2, there is shown a partial side elevation of the paver 10 to illustrate advantageous locations of sensors which are used to control the position of the screed 12. A grade reference 71 is shown as a broken line to illustrate any of a number of known grade reference markers which may be used for gauging the correctness of the height of paving material 72 after it is laid down as a paved mat 73 by the screed 12. The grade reference 71 may for example be a string line which defines a vertical, surveyed height along the ground. The auger conveyors 21 and 22 distribute hot asphalt paving material 72 in front of the front edge 51 of the screed 12 at a height higher than the final height of the paved mat 73. The screed 12 then strikes off and rides over the distributed material 72, compacting it into the paved mat 73 at a grade which corresponds ideally to the desired grade reference 71. A grade sensor 75 may be mounted at the screed 12 laterally outboard of the screed 12 at one transverse end or side thereof. The grade sensor 75 would measure a vertical position of the screed 12 with respect to the specified grade reference 71 which may have been provided at the desired grade level laterally displaced next to the path of the paver 10. Since the final grade height of the paved mat 73 is substantially the same as the trailing edge 56 of the screed 12, the grade sensor may be advantageously located outboard from the trailing edge 56. The grade sensor may be a state of the art sensor having a wand which contacts and rides on the grade reference 71. However, more recently available non-contact sensors 75 are preferred, the non-contact sensors using ultrasonic ranging devices, such as those marketed by Polaroid. Ranging circuitry which may be part of control circuitry in the operator's control console 35 (see FIG. 1) provides a digital distance measuring signal referencing the sensor 75 to the grade reference 71. A mounting bracket 76 for the sensor 75 fixes the position of the sensor 75 to establish a vertical relationship between its readings of the grade reference 71 and the bottom surface 52 of the screed 12, such that the distance measured by the sensor 75 establishes the actual position of the paving bottom surface 52 of the screed 12 with accuracy. The right side of the screed 12 may similarly be equipped with a corresponding right side grade sensor 77 like the grade sensor 75 (see FIG. 3), when both sides of the pavement are to be controlled with respect to grade references, as the left side of the screed 12 is controlled with respect to the grade reference 71.

Positioning a grade sensor laterally next to the screed 12, and substantially laterally next to the paved surface-defining rear edge 56 of the screed 12, has in the past been considered detrimental to providing an accurate control over the screed 12. Prior art teaches that overcontrol tends to occur when a grade sensor, such as the sensor 75, is located directly at the screed. Nevertheless, in accordance herewith, the sensor 75 is preferably mounted to the screed 12 to monitor directly a vertical position of the screed 12 with respect to the specified grade reference 71. But instead of generating a deviation-correcting control signal that depends directly on the magnitude of the deviation obtained from the sensor 75, a deviation signal is related to the distance of travel of the paver 10 over which it occurred, as may be obtained from the magnetic pickup 48. A corrective change in the angle of attack of the screed 12 is then applied to offset the angle at which the deviation of the screed 12 is expected to progress.

Accordingly, the control console 35 on the tractor unit 11 is considered to be an ideal control center 35. Consequently, the tractor unit 11 may be selected to conveniently house electrical circuits associated with the control console including selected relay or power systems for controlling the angle of attack of the screed 12. The control center 35, by such systems, issues control signals to the hydraulic system of the paver 10, as represented by the cylinders 65, 66, to raise or lower the screed pull arm 61, for example, based on a rate of change in the vertical position of the screed 12 with respect to the grade reference 71, as the paver 10 travels along its path in the direction of arrow 78. The sensor 75 may be operated to take thirty vertical distance measurements per second, for example. A running average of ten or more of the measurements may be stored to define a hypothetical first measuring point in time along the path of the paver 10. Simultaneously with the vertical distance data or grade measurements taken by the sensor 75, the magnetic pickup 48, or any equivalent angular displacement counter, generates a signal which is translated by the console 35 into linear advance or horizontal distance travelled by the paver 10 as well as into a speed indication, hence, an incremental distance with respect to time. For example, at a paving speed of 60 FPM (sixty feet per minute) the paver advances 12 inches per second. When thirty grade measurements per second are taken by the grade sensor 75, each measurement is linearly spaced by 0.4 inches from the previous one. Of course, the linear spacing of the sensing intervals would vary with the speed of the paver 10. Consecutive averages of ten grade readings, for example, may be started at each reading. Thus, ten sets of average readings may accumulate simultaneously. With simultaneous accumulation of data, an averaged set of ten readings represents an averaged reading with respect to a midpoint of the sampled distance located, according to the example, two inches back from the point at which the last of the averaged readings was taken. A subsequent set of ten averaged grade readings would be completed with the next subsequent measurement, hence, 0.4 inches later rather than ten samplings or four inches later.

3. Dual Grade Sensor Operation

When two successive averaged sets of grade readings are the same and also, the averaged grade readings correspond to the specified grade, there is no need to change the angle of attack of the screed 12 and the extension of the cylinder 65 would consequently remain without extension or retraction of its piston. When, however, a set of averaged grade readings first shows a deviation of the screed 12 from a specified grade reference 71, the magnitude of the deviation taken over the horizontal advance of the paver 10 since the last correct grade reading is taken as defining an angle or slope in the direction of travel of the paver 10, which angle corresponds to a rate of deviation with respect to a desired grade level. The slope or rate at which the screed 12 has deviated from the grade may be extrapolated to infer a continued increase in the measured error as the paver 10 continues to advance. To cancel or offset a further increase in the deviation of the screed 12, assuming the deviation continues to progress at the measured rate, the angle of attack of the screed 12 would need to be altered by an angle equal and opposite to the measured rate of deviation. In accordance with the described sensing arrangement, grade corrections to the screed no longer are made to correct for measured deviations, but to steer the screed 12 in a vertical plane, either up or down, to retain the screed 12 on its vertical, prescribed course, namely at the grade reference. Thus, rather than making reactive corrections of an abrupt nature, the cylinders 65 and 66 are controlled to reorient the screed 12 in a vertical plane along the longitudinal axis or line of travel 78 of the paver 10. Immediate and successive corrections of small incremental steps applied to reorient the screed 12 in the described manner desirably produce a greatly improved paving profile. Each correction is accordingly defined as a change in the angle of attack at which the screed 12 is pulled by the tractor unit 11 onto the distributed paving material 72. A most recent angle of attack without deviation is taken as a reference angle for correcting slopes of deviation by the screed 12, thus only a change with respect to the prior reference angle of attack would be computed to impose a corresponding reorientation on the screed 12.

After the screed 12 has been "nulled" at the beginning of a paving operation, an initial orientation of the screed 12 is defined by the elevation of the pull arms 61 and 62 with respect to the specified grade. The orientation of the screed 12 in the vertical plane through the longitudinal axis of travel 78 and with respect to the desired grade may be measured and controlled by right and left forward pull arm grade sensors 81 and 82. As will become apparent, the interaction of the left pull arm and screed sensors 81 and 75, and of the right pull arm and screed sensors 81 and 77 as pairs controls the positioning of the screed 12 with respect to the grade reference 71 located on the same side as the respective sensors.

After initializing or "nulling" the sensors on the paver 10, each of the sensors 75 and 82, as shown in FIG. 2, for example, may have a distinct actual distance to the grade reference 71. Independently of the actual distance from the respective sensor 75 or 82 to the grade reference 71, the initial distance is interpreted as a "null" setting with respect to the grade reference in both instances. If the wheel 37 of the paver 10 rolls over a high point in the base grade during the paving operation, the pull arm sensor 82 would read a corresponding deviation from the null setting and a corresponding activation of the cylinder 65 would maintain the null or reference distance of the sensor 82 to the grade reference 71 while the pull arm becomes repositioned with respect to the tractor unit 11 of the paver 10. Such a correction of either one or both of the pull arms 61 and 62 to maintain a set distance with respect to the grade reference 71 may occur at any time. Any such repositioning of the pull arm 61 and 62 would occur in addition to any of the previously described vertical pull arm repositioning to correct for a deviation of the screed 12 from the grade reference 71.

The actual location of the sensors 81 and 82, namely their distance forward of the rear edge 56 of the screed 12 has been found to be of significance to control the position of the screed. The actual location of the sensors 81 and 82 is used in ascertaining a correspondence of corrective changes in the positions of the pull arms 61 and 62 in relation to desired changes in the angle of attack of the screed 12. A measured change in height of the pull arm 61, for example, from its previous height above the grade reference divided by the distance to the trailing edge 56 of the screed 12 defines an angle representative of a change in the angle of attack of the screed 12. Once the screed pull arms 61 and 62 have been raised or lowered to cancel out an increase in a measured deviation, a correction adjustment, applied for a predetermined number of measuring intervals and amounting to a predetermined fraction of the measured deviation, may be applied to the control signal for the cylinders 65 and 66 to steer the screed to its correct grade position. It is to be noted that current corrective action may be superimposed on subsequent screed position corrections and that such subsequent actions may either increase or diminish any ongoing corrections. From the further description of the controls it will become apparent that grade corrections as well as transverse slope corrections of the screed may be made simultaneously.

Figure 3:
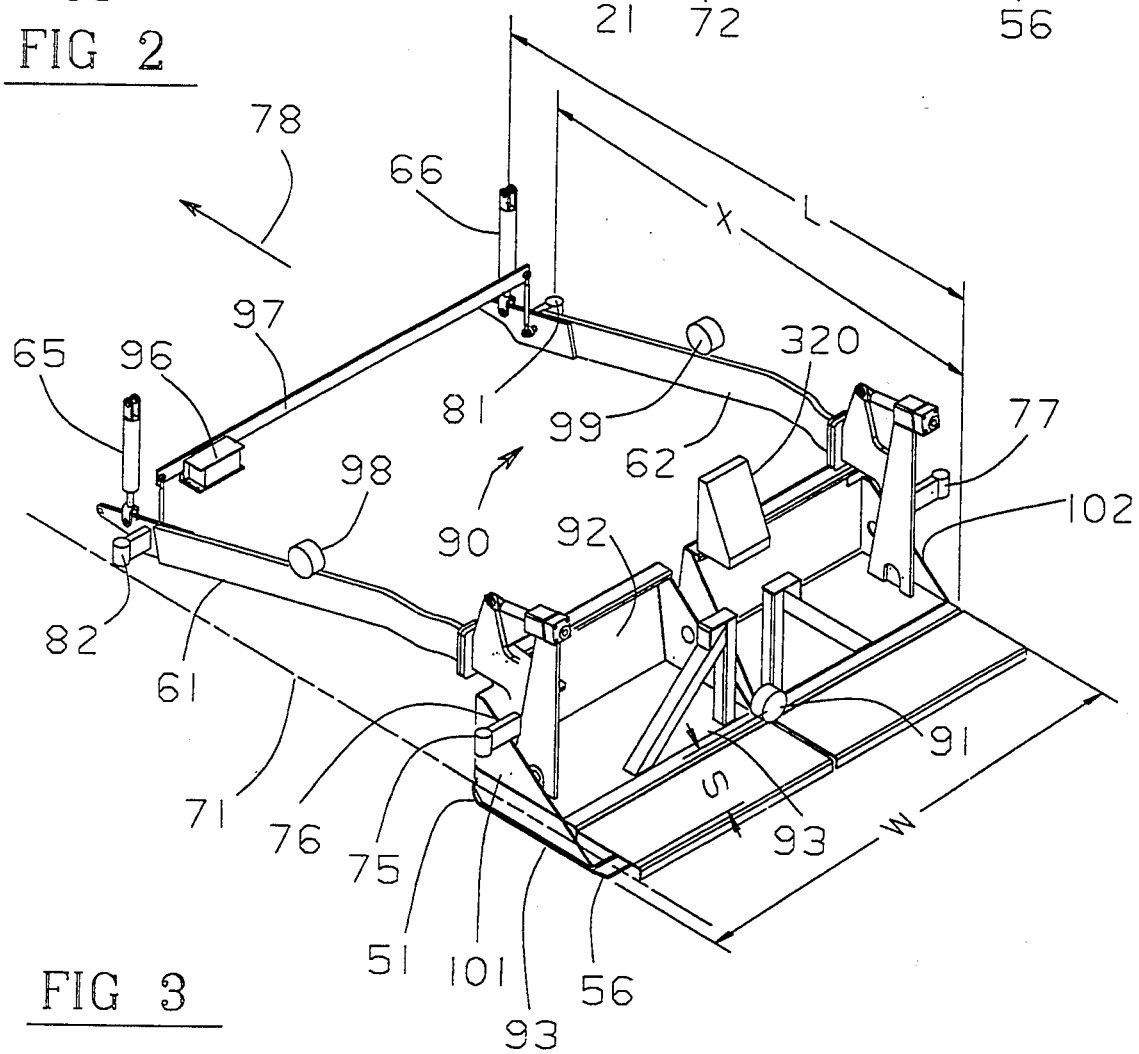
FIG. 3 is a simplified pictorial view of a screed and screed arms of the paver in FIG. 2, further illustrating preferred screed controls in accordance with the invention.
Figure 4:
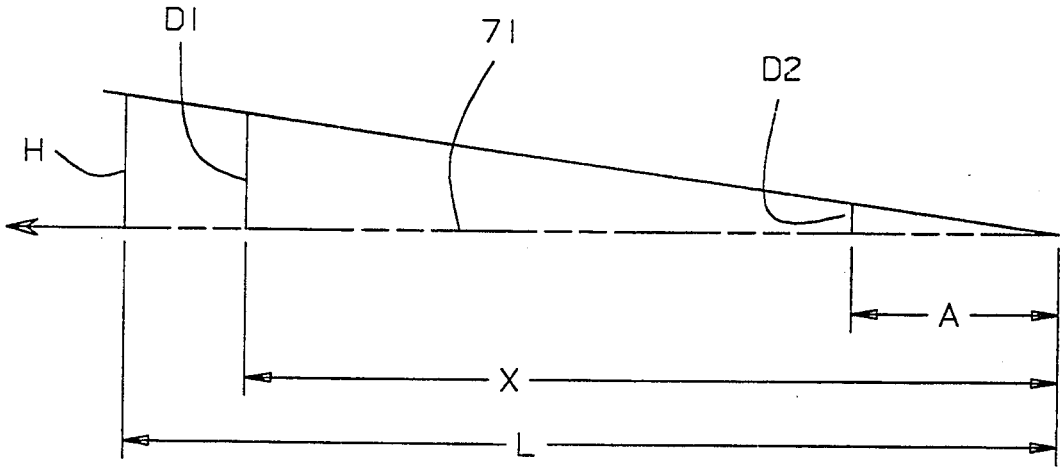
FIG. 4 is an elevational diagram showing illustrating various magnitudes of vertical deviations along a screed and pull arms of a paver.

In reference to FIGS. 3 and 4, a distance "L" from the rear edge 56 of the screed 12 to the pull arm positioning cylinders 65 and 66 may exceed the distance "X" by which the front pull arm sensors 81 and 82 are located in front of the rear edge 56 of the screed 12. Thus, cylinders-piston extension changes during a corrective alignment, designated by "h" would proportionally differ from the change in height measurement by the respective front pull arm sensors 81 and 82, designated by "d1" in the same proportion as the distance "L" exceeds the distance "X". Also, if the sensors 75 and 77 are mounted forward of the effective rear edge 56 by an appreciable distance "a", it becomes apparent from FIG. 4 that a corrective change of the pull arms 61, 62 with respect to the grade reference 71 results in a proportional height change with respect to the grade reference 71 and in a changed null measurement by the sensors 75 and 77 with respect to the actual position of the trailing edge 56 of the screed. It is therefore desirable to mount the screed position sensors 75 and 77 close to the grade defining edge 56 of the screed 12, in which case the nulling change (D2) becomes negligible.

The described dual grade sensor arrangement of a first grade sensor 75 mounted to the screed 12, and interactively working with a second grade sensor 82 mounted on the same side of the paver 10 forward of the screed on the pull arm 61 may be used in conjunction with another like set of grade sensors on the other side of the paver 10. Each set of sensors, either sensors 75 and 82 or sensors 77 and 81 would work independently of each other as left or right sets of dual sensors to control both the grade and slope of the screed 12 when both left and right grade references 71 are provided.

When the grade reference 71 is provided on only one side of the paver 10, say on the left hand side, as shown in FIG. 2, then the sensors 75 and 82 may be used as described herein to control the grade of the screed 12 on the left side of the paved mat 73. A specified transverse slope across the width of the paved mat 73 may then be controlled by a known slope sensor in addition to the described dual sensor grade control on the side of the provided grade reference 71. The same transverse slope sensor may be used when the grade reference 71 is moved to the other side of the paver 10 and the dual sensor grade control shown on the other side of the paver 10 is used, such as shown by the screed grade sensor 77 and the corresponding pull arm sensor 81.

It may have been recognized also, that the grade may be controlled in accordance herewith when only a single grade sensor, such as the sensors 75 and 77 are located directly at the screed 12 and even laterally of the grade defining rear edge 56 thereof. In such an arrangement, a computed correction to an angle of attack of the screed 12 needs to be applied while being controlled other than by referencing the front of the pull arms 61 or 62 to the grade reference 71, such as by the forward grade sensors 81 or 82. A controlled change of the extension of the cylinders 65 and 66 may be chosen to move the pull arms through an approximate angle corresponding to the determined angle of deviation by the screed from the specified grade reference 71. The modification deleting the forward pull arm grade sensors 81 and 82 has, however, disadvantages over the dual sensor grade control in that the lack of the forward grade sensors eliminates any indication of a vertical change in the base which vertically repositions the paver 10 with respect to the grade reference and thereby changes the angle of attack. Another disadvantage is that a single grade sensor located at the screed cannot anticipate a grade change to pro-actively allow corrections in the orientation of the screed 12.

4. Dual Transverse Slope Sensor Arrangement

A dual slope control arrangement designated generally by the numeral 90 will be described in reference to FIGS. 2 and 3. In contrast to known dual slope controls, the dual slope control 90 includes, besides a transverse slope sensor at the screed 12, devices which determine the slope with respect to a reference or null slope in each of the pull arms 61 and 62. The dual slope control 90 in accordance herewith includes a known slope sensor, such as a gravity type pendulum sensor, which advantageously may be mounted directly to the screed 12 to indicate a transverse slope of the screed 12 with respect to the horizontal. FIG. 2 shows a screed transverse slope sensor 91 mounted against an upright forward wall 92 of the screed 12. FIG. 3 shows the slope sensor 91 in a simplified representation of the screed 12 mounted across a bottom plate 93 of the screed 12. In either position, a transverse slope of the screed 12 with respect to the horizontal would be substantially indicated. Because the bottom surface 52 of the screed 12 would be subject to twisting during slope corrections, the actual slope of the paved mat 73 would be sensed most accurately when the slope sensor 91 is located closely adjacent the rear edge 56 of the screed 12. However, a forward displacement of the slope sensor 91 by a distance "s", as shown in FIG. 3 still approximates the slope of the paved mat 73 which is located directly below the slope sensor 91.

It should be apparent that a transverse slope control generally would not be needed when grade references 71 exist on both sides of the paver 10. The sensors 75 and 82 on the one side and the sensors 77 and 81 on the other side of the paver 10 fully define the position of the screed 12 with respect to the grade references. The relationship of two spaced grade references 71 inherently includes any specified transverse slope between the references. When, however, only a single grade reference 71 is used, for example on the left hand side of the paver 10 as shown in FIGS. 2 and 3, a measurement and control of the slope across the screed 12 becomes necessary to ascertain a correct vertical position of the screed 12 on the other side of the grade sensor. State of the art slope controllers use gravitational sensors, such as the sensor 91, which have a digital slope indication with a resolution of 0.1 of a percent of slope. A control knob allows a screed operator to "dial" in a desired transverse screed slope in increments of such tenths of a percent of slope.

The dual slope control 90 deviates from known control procedures. Instead, the control procedure described above with respect to the dual sensor grade control has been found to apply advantageously to the dual slope sensor control arrangement 90. While a grade correction implies a vertical position change of both pull arms 61 and 62 in unison, a slope correction is carried out by changing the vertical position of one of the pull arms 61 and 62 with respect to the other to introduce a skew or twist into the screed 12. According to a first procedure the dual slope control 90 may sample the reading of the screed slope sensor 91 at timed intervals. More frequent readings intermittent the desired sampling interval may be taken and the readings may be averaged to generate a measured average slope indication since the prior most recent reading. In reference to the described grade control procedure, the distance travelled by the paver 10 during each slope sampling interval is also available from the linear advance data obtained by the magnetic pickup sensor 48 and is advantageously used for slope correction in accordance herewith. Each of the slope readings obtained from the slope sensor 91 is compared to a specified slope across the screed 12 at the measured location of the screed 12 along the path of the paved mat 73 to determine whether a deviation exists. When a deviation from the specified slope is first obtained, a slope correction of an advantageous magnitude will be applied.

Lacking a direct vertical correction reference on the right side of the paver 10 (the grade reference 71 being located on the left side of the paver), a measured correction is desirably calculated and controllably applied with the help of at least one additional slope sensor 96. The slope sensor 96 is preferably the same type of sensor as the slope sensor 91 on the screed 12. The slope sensor 96 is mounted to obtain a reading which indicates a slope difference between the pull arms 61 and 62.

The slope sensor 96 is shown in FIG. 3 as being mounted to a cross beam 97 disposed across forward portions of the pull arms 61 and 62. It is understood that structural interference may prevent the cross beam 97 to extend straight between the screed pull arms 61 and 62 at the location indicated in FIG. 3. In the past, upright beams or other structures have been used to obtain a feasible location to position the cross beam 97 transversely across a paver for locating the slope sensor 96 to measure a slope between the pull arms. FIG. 3 also shows two slope sensors 98 and 99 which may be mounted to the left and right pull arms 61 and 62, respectively. The slope sensors 98 and 99 may be used in lieu of the single second slope sensor 96 and provide a direct reading of any difference in the slope between pull arms 61 and 62. As can be seen from FIG. 3, slope readings of the single second slope sensor 96 show an angular difference between the left and right pull arms 61 and 62 with greater accuracy as the location of the cross beam 97 is displaced forward along the lengths of the pull arms.

Regardless of where the slope sensor 96 is located forward of the screed 12, the distance from the trailing edge 56 of the screed to the location of the slope sensor 96 ("X") and also the distance ("s") by which the slope sensor 91 is displaced forward of the trailing edge 56 are quantities deemed significant if not necessary for a substantially accurate computation of a corrective slope control signal for the screed 12. A further known quantity which may advantageously be used in the calculation of a correction factor in accordance herewith is a transverse length of the screed, designated herein as the width ("W") across the screed 12.

An example of a slope correction is given in reference to a correct grade position of the screed 12 with respect to the grade reference 71 at a left transverse end or the left side 101 of the screed 12. In contrast to prior art methods, a correction advantageously makes use of an actual vertical excursion of the screed 12 at a right transverse end 102 of the screed, also referred to as its right side 102, as a result of the measured error in the transverse slope of the screed 12. The error in slope as measured by the slope sensor 91 when extended over the width of the screed 12 amounts to the vertical deviation of the screed 12 at the right side 102 from an expected norm. Accordingly, the measured slope error at the screed 12 may be multiplied by the width "W" to obtain the vertical deviation of the screed 12 at the far side 102 in terms of a vertical linear measurement. As is done to correct an error in grade, the vertical deviation value is used to determine a corrective twist to be applied to the screed 12. The vertical deviation at the far side 102 of the screed since the most recent correct slope measurement defines a vertical leg of a longitudinal deviation angle in the direction of travel and with respect to an intended correct path of the screed 12 at the right side 102 thereof. The slope of the deviation angle may be computed by dividing the vertical error by the distance the paver 10 has advanced since the most recent correct slope measurement. To the computed correction angle, a return angle may be added, for example, of one half of the computed angular deviation in the direction of travel. Returning the screed 12 to the correct slope over two measurement periods allows for further corrective action to prevent overshoot on the correction. The added return angle would then advantageously be applied for two measurement periods to approximately return the screed 12 to its correct slope. Instead of applying a corrective return angle of one half of the computed angular deviation over two paver advance measuring intervals, a comparatively lesser portion of a corrective return angle may of course be applied for a correspondingly greater number of paver advance measuring intervals. In any event, subsequent corrections are expected to be made based on updated and most recent measurement data. Summarizing the described slope correction, the magnitude of the transverse slope deviation is advantageously converted to an angular deviation with respect to the distance travelled by the paver 10. A corrective twist is then applied to the screed 12 which cancels out the computed longitudinal angular deviation and applies a corrective twist for returning the screed 12 to the specified reference slope across the screed.

With the grade reference 71 on the left side of the paver 10, the corrective twist to the screed 12 would be applied by activating the cylinder 66 to reposition the right pull arm 62 with respect to the left pull arm. The magnitude of the twist is measured by the slope sensor 96 across the pull arms with respect to the slope sensor 91 across the screed 12. The correction slope is added to a current datum, "null" or reference value for the slope sensor 96. The corrective action raising or lowering the pull arm 62 continues until the actual reading by the sensor 96 corresponds to the new null reading. The added corrective value on the sensor 96 would be the determined corrective twist of the screed 12 divided by the width "W" and multiplied by the longitudinal distance (X-s) between the slope sensors 91 and 96. When the left grade sensors 75 and 82 are measuring to the grade reference 71 as shown in FIGS. 2 and 3, the left cylinder 65 is activated to control the orientation of the screed 12 with respect to the grade reference 71. A deviation from a desired "null" setting of the slope sensor 96 as corrected in accordance herewith generates the control signal which activates the right hand cylinder 66 to control the transverse slope of the screed 12. The slope sensor 96 consequently functions also as a slaved grade controller for the right side of the screed, the right pull arm following any change in attitude of the left pull arm because of a grade correction.

The corrective functions by the cylinders 65 and 66 become reversed when the grade reference 71 is located on the right side of the paver 10. The grade sensors 77 and 81 control the position of the right side 102 of the screed 12 with respect to a grade reference through selective activation of the cylinder 66, while an error signal from the slope sensor 96 activates the cylinder 65 to null the error signal.

When, in the alternative, the slope sensors 98 and 99 are provided in lieu of the single slope sensor 96, and these alternative slope sensors 98 and 99 are activated to control a corrective movement of the pull arms applied through the extension or contraction of one of the cylinder-pistons 65 and 66, a slope correction, as determined from a slope measurement by the slope sensor 91 as described, will be applied directly as a slope difference between the slope sensor 98 or 99. Such difference will be temporary and will be updated until a correct slope or grade measurement is obtained at the screed. In controlling the grade of the paved mat 73, the slope sensor mounted to the pull arm on the side of the direct grade control to the grade reference 71 becomes the controlling or reference slope sensor, while the other slope sensor becomes the slaved slope sensor. Thus, for grade control, the orientation of the slaved slope sensor would be altered until its reading matches the reading on the controlling slope sensor. The slope control using the slope sensor 91 would be implemented in addition to the grade control.

The described slope control 90 is advantageous for transitioning into and out of banked pavements due to curves. Current slope change procedures require that a screed operator changes the amount of slope dialed into an automatic slope control panel when the screed of the paver passes a slope marker, such as a stake placed along the route followed by a paver. Such a marker may be placed every fifty feet, for example. The inherently lagging response to changes by the screed 12 has in the past resulted in a stepwise, yet tolerable slope transition into and out of curves.

The described slope control 90 may be used to permit an operator of the paver 10 to set a controlled rate of slope increase at the control console 35 as the paver 10 advances into a curve, and conversely of slope decrease as the paver 10 advances out of the curve. The use of the screed slope sensor 91 and the forward pull arm slope sensor 96 requires that a constant difference be maintained between the slope sensors 91 and 96 as the paver 10 pulls the screed 12 into the curve. The rate of increasing slope may be maintained until a slope below the specified bank of the curve is obtained, at which point the slope setting of the lead slope sensor 96 is no longer increased and the screed 12 asymptotically approaches the optimum slope. The slope sensor 91 preferably controls the bank or transverse slope of the mat 73 within the curve, as described above.

Figure 5:
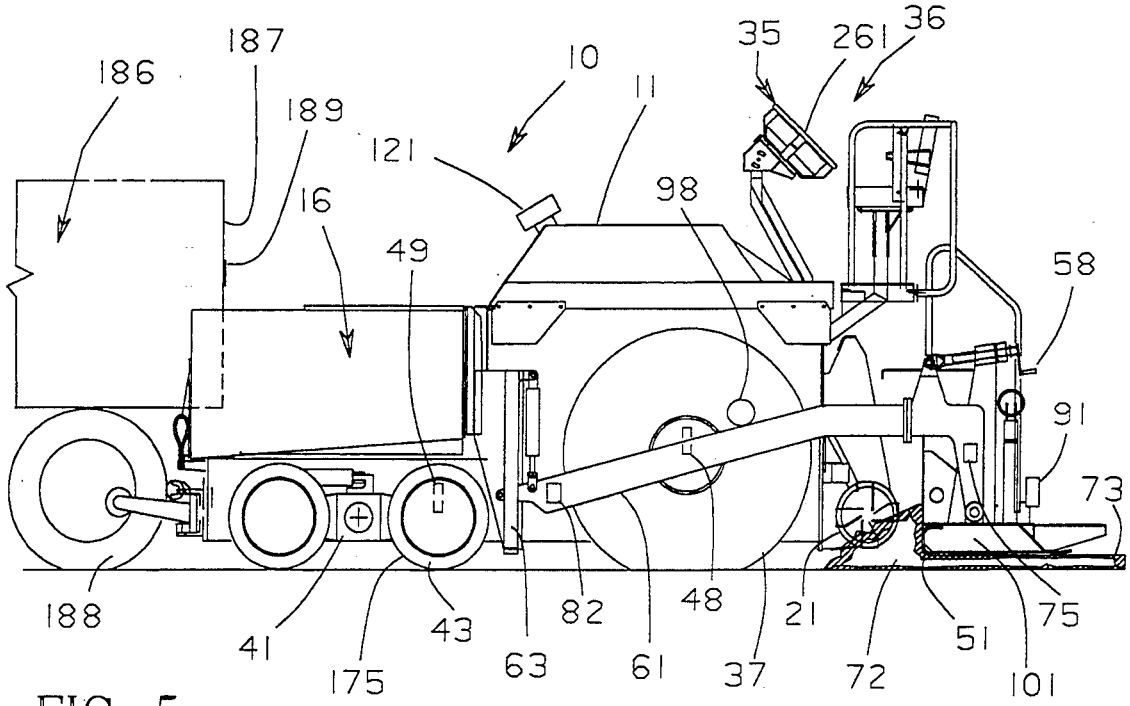
FIG. 5 is a simplified side view of a paver and a material delivery truck positioned to deliver material to a hopper of the paver, the side view showing positions of linear advance, grade, slope and material supply sensors.

In reference to FIGS. 3 and 5, controlling a rate of increase or decrease of the transverse slope of the paver 10 while paving into or out of a curve also may be accomplished with the alternate slope sensors 98 and 99. A specified twist or slope difference between the pull arms 61 and 62 may be established and measured as a difference between the slope sensors 98 and 99, rather than with respect to the slope sensor 91 at the screed 12. To improve transition, the twist or slope difference between the sensors 98 and 99 may be applied in a series of equal increments leading into a specified change of slope, and taken away in a series of equal increments as the desired slope is approached.

5. Material Supply Controls

Figure 6:
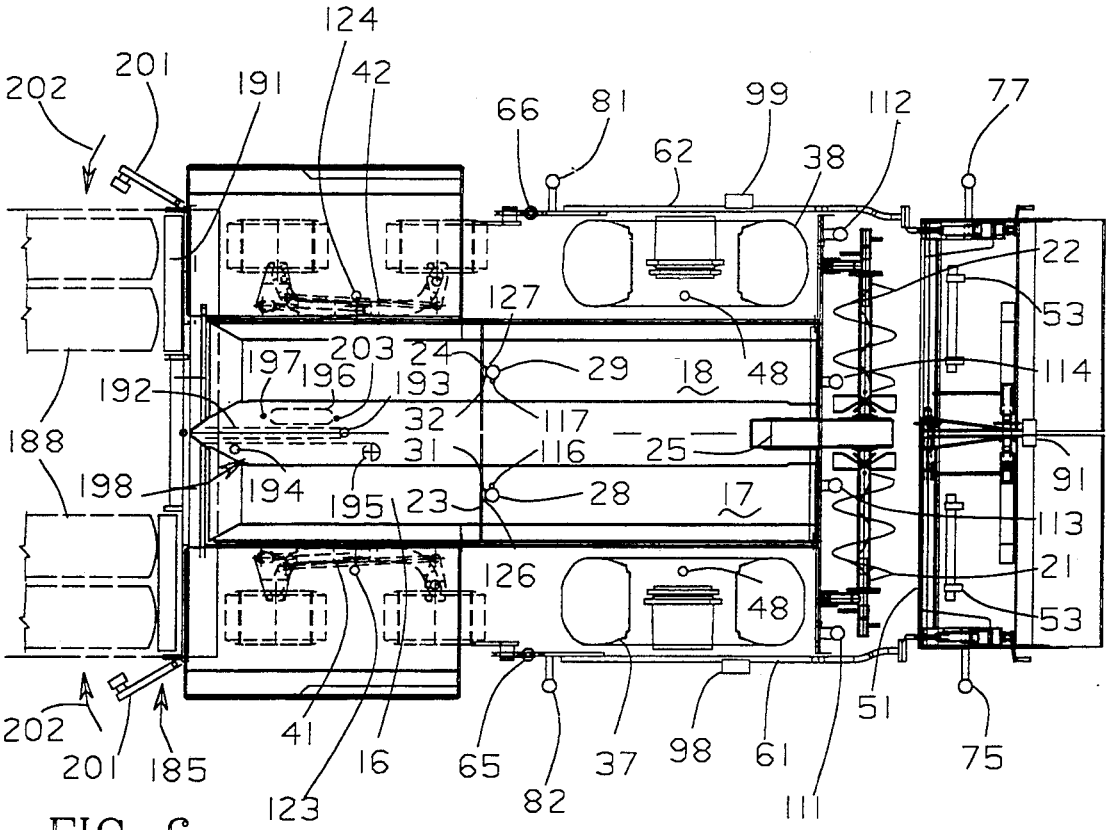
FIG. 6 is a simplified plan view a lower portion of a paving machine, with parts of the paver removed to depict material control, grade and slope sensors as they may be used in accordance with the invention.

Further improvements and advantages relating to the material feed control may be understood from the following description in reference to FIGS. 5 and 6. The material height transversely ahead of the screed 12 is provided by the left and right auger conveyors 21 and 22, respectively. The speed at which the auger conveyors 21 and 22 distribute the material to their respective sides is according to known prior art processes controlled by outboard left and right material sensors 111 and 112. The sensors 111 and 112 have in the past been wand type sensors which operate by dragging a wand over the surface of the material 72. The angle of the wand corresponds to a setting of a variable resistor which in turn produces a control signal of appropriate magnitude across its terminals. More recently, non-contact, particularly ultrasonic sensors, such as the sensors 111 and 112 have been used for controlling the distribution of material 72 across the width of the screed 12. Though the preferred ultrasonic sensors may be used to generate a control signal to maintain the height of the material, a preferred manner of using the ultrasonic sensors 111 and 112 is in accordance with their well established property to measure distance from the sensors 111 and 112 as an input to a control function implemented by the control console 35. The sensors 111 and 112 consequently provide an inferred reading of the amount of material present adjacent the outboard ends of the respective left and right auger conveyors 21 and 22. Pursuant to teachings in U.S. Pat. No. 4,933,853, second left and right sensors 113 and 114, respectively, are mounted adjacent left and right inboard ends of the augers 21 and 22. Readings by the second sensors 113 and 114 are compared to the readings of the first set of sensors 111 and 112. When the inboard sensors 113 and 114 indicate a higher level of material, hence more material 72, near the center of the screed than adjacent the outboard ends of the respective auger conveyors 21 and 22, too much material may have been supplied to the screed 12. According to established and preferred practice, the material supplying left and right slat conveyors 17 and 18 are geared in speed to the proportional speed of the material distributing auger conveyors 21 and 22, respectively. The amount of material supplied to the screed 12 by the slat conveyors 21 and 22 is controlled by a vertical height setting of the respective left and right flow gates 23 and 24. When, for example, an excess of material is sensed by the inboard sensors 113 and 114 with respect to the material at the first, outboard sensors 111 and 112, a control signal is computed at the control console 35. The control signal activates the respective vertical left and right vertical positioning screw drives 28 and 29 to lower one or both of the flow gates 23 and 24. Thus, the outboard sensors 111 and 112 sense whether the desired amount of the material has been distributed across the width of the screed 12. The inboard sensors 113 and 114, on the other hand, monitor whether a sufficient amount of the material 72 is being released from the hopper 16 to supply the desired amount of material as established by the control console 35.

In accordance herewith, left and right gate height sensors 116 and 117 are coupled to the vertical positioning screw drives 28 and 29 to permit the control console 35 to compute and maintain a record of a material usage rate and instantaneous, average and total material usage related to a paving job. The left and right gate height sensors 116 and 117 may be revolution and angular displacement counters coupled to the respective screw drives 28 and 29. At the beginning of a paving job, the height of the flow gates 23 and 24 may be adjusted and the respective sensors may be set to correspond to the adjusted heights. A instantaneous material volume usage may then be computed by cross-sectional areas of openings 118 and 119 (see FIG. 1) between the flow gates 29 and 29 and the slat conveyors 17 and 18, multiplied by a rate of linear advance of each of the slat conveyors 17 and 18 during an incremental time unit. A computed instantaneous material flow or supply rate is summed by increments or integrated over a consecutive number of timed measuring intervals to achieve total material usage over measured lengths of pavement and to compute average usage rates. Totalized material usage readings may be restarted to accumulate from any set starting point during the paving process. A reset accumulation count may be used to compute material usage for certain paved sections, such as a curve. To implement the latter feature, the control console 35 may conveniently include a "paved volume reset" feature. Such a reset feature would not, however, cause a reset of a long-term totalized material usage record. A corresponding usage by weight of the material 72 is computed by multiplying the computed volume rate of usage by a predetermined material density or weight per volume which, though varying slightly with materials, may be determined, and often is, at the beginning of each paving job. A record of total tons of material paved may be used in cost accounting and also in controlling the quality of paved mats 73.

A computed rate of material usage may be confirmed by reading a material reserve which is present in the hopper 16. It is contemplated to measure the amount of material dumped by a material supply truck during each respective material unloading operation. The amount of paving material 72 within the hopper 16 may be estimated, for example, by measuring the height of material deposited in the hopper 16 by a material supply truck. The height and shape of deposited material may be measured by a non-contact sensor 121 which may be mounted on the motor hood, for example. Left and right sensors 121 may be used to compute a volume of the material within the hopper 16. However, inaccuracies in volume computations from such distance measurements may be present even when plural ones of the sensors 121 are used. As an alternative, or even in addition to estimating the volume of material with readings from the sensors 121, a weigh cell arrangement may be used, the arrangement including left and right weigh cells 123 and 124 coupled to the respective left and right tandem wheel assemblies 41 and 42 and their respective suspension points of the hopper 16. A reference weigh cell reading may be "nulled" or set at the beginning of each paving job. When a dump truck delivers a load of material to the paver 10, an increase in weight is registered in its totality by the combined readings on the two weigh cells 123 and 124. Readings of diminishing weights sampled by the control console 35 at particular intervals during paving operations and between successive material deliveries may be used advantageously in computing an optimum forward rate of advance for the paver 10. Such optimum paving rate would approximate an upper paving speed which can be sustained during a continuous paving operation without having the paver 10 run out of paving material 72. Any material shortage at either the left or the right side of the paver 10 may be detected by the alarm switches 31 and 32 as a last resort to interrupt paving when a lack of the material would shortly thereafter cause voids to be paved into the paved mat 73.

Also coupled to the alarm switches 31 and 32 are left and right temperature probes 126 and 127. The temperature probes 126 and 127 may be well known thermocouples which are disposed on actuators of the limit switches 31 and 32 and would remain in continuous contact with the material being supplied from the hopper 16. Knowledge of the temperature of the material about to be paved into the mat 73 is found to be of significance. The material 72 will be more pliable or fluent when it is supplied at a relatively higher temperature than when it is already cooled to a temperature less than that in a desirable range. Thus, when fresh material is supplied from a load delivered at a relatively higher temperature, the material would typically be more fluent than the same material after it has cooled. As a result a height to which the material is distributed across the leading edge 51 of the screed 12 may need to be reduced when the more fluent material 72 is distributed. Readings from the temperature sensors 126 and 127 may be stored to record, in relation to time and travel distance, data to correlate any resulting deviations of the screed 12 to changes in material temperature data.

6. The Control Console

Figure 7:
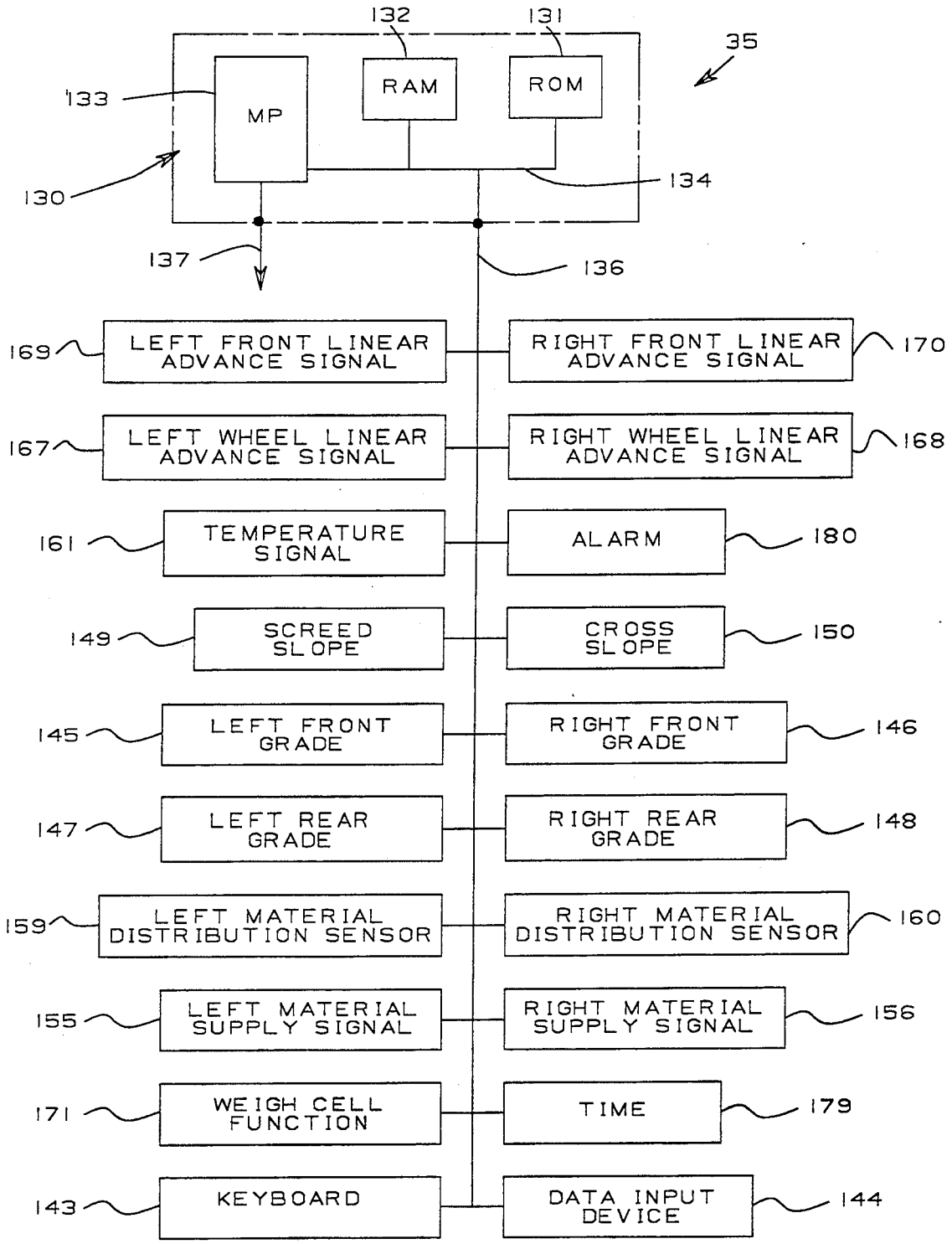
FIG. 7 is a function diagram showing a control circuit of the paver and major sensing functions coupled to the control panel of a paving machine.
Figure 8:
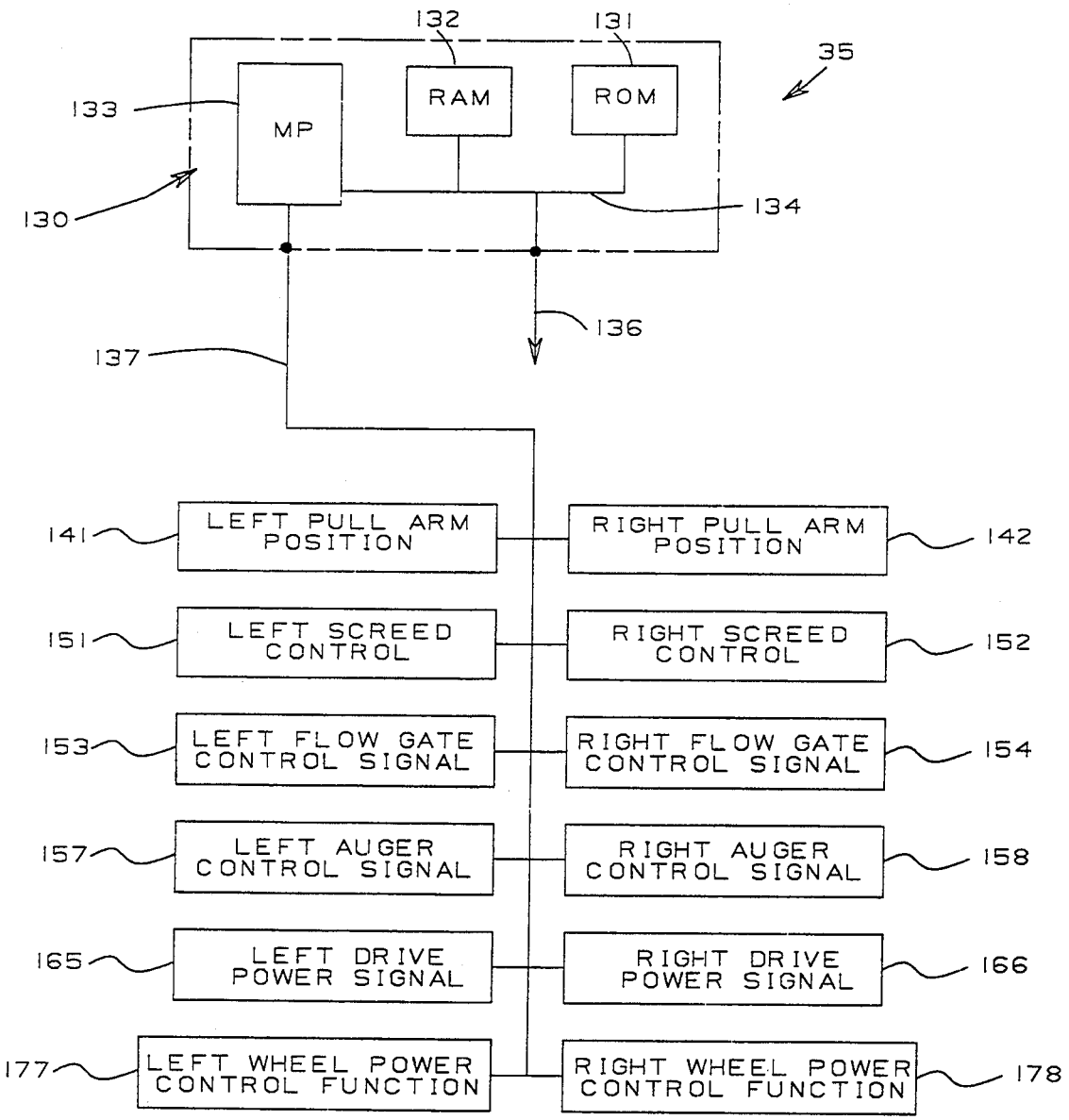
FIG. 8 is a function diagram showing the control circuit of FIG. 7 and showing control functions of the control circuit.

The above control procedures may be combined advantageously in a microprocessor controlled control circuit which is preferably housed in the control console 35. FIGS. 7 and 8 show schematic function diagrams representative of a typical microprocessor circuit 130 which may include a read only device 131 ("ROM") and a typical random access memory device 132 ("RAM"). Both memory devices 131 and 132 are communicatively coupled to a microprocessor device 133 ("MP") via data and address buses schematically represented by a data communication bus 134 which may be a typical sixteen-line bus of a state of the art microprocessor. The ROM memory device 131 may be a state of the art reprogrammable flash memory device instead of a typical mask programmed read only memory device. It is also understood by those skilled in the art that the above described sensor signals will be coupled to the microprocessor circuit 130, and particularly to respective data lines of the data bus 134 through proper data interface circuits considered to be part of the respective schematic functions. Signal interface and buffer circuits may advantageously be located within the control console 35. FIG. 7 shows a data connection bus or signal network 136, which may be a cable harness 136 to communicatively couple described sensor signals as measured paver status signals to the microprocessor circuit 130 or an equivalent control circuit. Reference to FIGS. 5 and 6 may be made with respect to the above-described physical elements referred to in the description of signal functions with respect to FIGS. 7 and 8.

The memory device 131 is shown as a preferred example of a device which stores instructions to the microprocessor 133. The memory device 131 contains a predetermined operating procedure according to which the operations of the paver 10 are controlled. Mechanical operations the paver 10 and those of orienting or positioning the screed 12 are performed in response to status signals received from sensors described herein, such as the linear travel sensors, such as the magnetic pickup devices 48 and 49, or the grade and slope sensors 75 and 91, respectively. The device 131 controls the sequence of functions which are executed by the microprocessor 133. In operation, the control program contained within and represented by the device 131 causes the microprocessor 133 to determine an angle of deviation of the screed 12 from the grade reference 71, as described herein. The microprocessor 133, as the control device or control signal generator, activates the cylinders 65 and 66 to change the angle of attack of the screed 12 by an amount which corresponds to the computed angle of deviation rather than by a value that corresponds to the magnitude of the deviation of the screed 12 from the grade reference 71 shown in FIGS. 2 and 3.

FIG. 8 shows various functions coupled to a control signal output bus 137. The schematically depicted bus 137 represents a multi-line signal output line 137 from the microprocessor circuit 130. The signal output line 137 is representative of an electrical communication system for carrying control signals to respective electrical and hydraulic power systems of the paver system 10, such as the screw drives 28 and 29, or the hydraulic motors 46, for example. These power systems operate the respective subsystems or devices of the paver 10. Control signals may be positive or negative on-off signals or the signals may be analog-type voltage signals which are further amplified to controllably operate a respective device, such as would desirably be done in a proportional speed control for driving the paver 10 or in a proportional conveyor-auger drive control.

In reference to FIGS. 7 and 8, left and right pull arm positioning signals 141 ("LEFT PULL ARM POSITION") and 142 ("RIGHT PULL ARM POSITION"), respectively, activate the appropriate hydraulic actuators to raise or lower the respective left and right cylinders 65 and 66. The cylinders 65 and 66 may be activated by positive and negative control signals driving a control valve in either one or the other direction to raise or lower the respective cylinder. In the alternative an analog signal may be provided to control a proportional actuator for metering a variable rate of flow of hydraulic fluid into or out of the respective cylinders 65 and 66. Control signals are applied to correct calculated deviations of the screed 12 from a specified slope or grade. Both slope and grade corrections are made through the functions 141 and 142. The specified slope data and grade measurement nulling data may have been entered into the memory 132 through a keyboard 143 or other data input device 144 ("DATA INPUT DEVICE") which may be accessible to an operator at the control console 35 on the operator's station 36 (see FIG. 5), for example. Stored grade reference signals are compared to the measured grade signals provided through respective grade data functions 145 through 148 ("LEFT FRONT GRADE", "RIGHT FRONT GRADE", "LEFT REAR GRADE" and "RIGHT REAR GRADE"). Slope measurements at the screed 12 are represented by slope function 149 ("SCREED SLOPE"), the described cross slope or twist of the pull arms with respect to each other is shown by the function 150 ("CROSS SLOPE"). The function 150 represents error signals obtained from either the slope sensor 96 or the slope sensors 98 and 99, as shown in FIG. 6.

Screed control functions 151 and 152 are contemplated to transfer manual screed angle of attack positioning as implemented via the lead screw mechanism 58. FIG. 1 shows a traditional mechanism 58 having a hand crank to permit an operator to manually null the screed 12. When the screed 12 is to be operated automatically as described herein, certain controls over the screed 12 may be exercised by the paver operator from the operator's station 36. In such an embodiment, the lead screw mechanism 58 may ideally be operated remotely by an electric motor, for example. Remote, automated operation may be provided in addition to the hand crank shown in FIG. 1. To implement such remote option, the lead screw mechanism 58 would include a motor and a lead screw position indicator as integral elements of the mechanism 58 as shown in FIG. 5, for example. Various optical or electronic angular displacement counters are available for use to generate electrical signals by which the current position of a lead screw mechanism 58 may be monitored and controlled from the control console 35. The functions 151 and 152 ("LEFT SCREED CONTROL" and "RIGHT SCREED CONTROL") represent the contemplated automatic screed control for nulling or initializing the position of the screed 12 by means of the lead screw mechanism 58.

Left and right flow gate control signal functions 153 and 154 ("LEFT FLOW GATE CONTROL SIGNAL" and "RIGHT FLOW GATE CONTROL SIGNAL") are predicated on input data from left and right material supply signal functions 155 and 156 ("LEFT MATERIAL SUPPLY SIGNAL" and "RIGHT MATERIAL SUPPLY SIGNAL"), respectively. A controlled height of the left flow gate 23 may differ from the height to which the right flow gate 24 is adjusted. Imperfections in the base over which the paving material is applied may require more paving material on one side of the paver 10 as compared to the other side thereof. As described above, the signal functions 155 and 156 are contemplated to use measured material height data from the outboard sensors 111 and 112 as well as from the inboard sensors 113 and 114.

Left and right conveyor and auger control signal functions 157 and 158 ("LEFT AUGER CONTROL SIGNAL" and "RIGHT AUGER CONTROL SIGNAL") control the speed at which the gear box 25 drives the left slat conveyor and transverse auger conveyor 17 and 21, and the right slat conveyor and transverse auger conveyor 18 and 22, respectively. The auger control signal functions 157 and 158 may be set initially to adjust the speed of the conveyors to distribute the material 72 across the screed 12 to rise to a default height at about the center of the auger conveyors 21 and 22. Left and right material distribution sensor signal functions 159 and 160 make use of distance measurements from the nulled or reference positions of the outboard sensors 111 and 112. Deviations of distances measured from the sensors 111 and 112 to the paving material with respect to the hulled or reference distances are inputs which may be used to determine the magnitude of the control signal which determines the drive speeds applied to the gear box 25. The conveyor and auger control signals 157 and 158 may further be modified, for example, in response to a change in a temperature signal function 161 ("TEMPERATURE SIGNAL") when the temperature sensors 126 and 127 record a change in the temperature of the paving material. An increase in temperature of the material 72 generally implies a more fluent material which consequently may require a lower material "pressure" or vertical height of material transversely ahead of the screed 12.

Left and right drive power signal functions 165 and 166 ("LEFT DRIVE POWER SIGNAL" and "RIGHT DRIVE POWER SIGNAL") control the magnitude of the drive power applied to the front wheels when the paver 10 has provisions for driving a left and right front wheel 43 of the respective front wheel assemblies 41 and 42. The magnitude of the control signal is varied to diminish or totally eliminate drive power to the respective front wheel 43 when slippage of the front wheel is noted by a difference between the respective forward travel signal of the main wheel and the forward travel signal of the corresponding front wheel 43. To arrive at a forward travel signal left and right main wheel linear advance signals 167 and 168 ("LEFT WHEEL LINEAR ADVANCE SIGNAL" and "RIGHT WHEEL LINEAR ADVANCE SIGNAL") may be averaged, as is presently contemplated for a preferred embodiment. Left and right linear advance signals 169 and 170 ("LEFT FRONT LINEAR ADVANCE SIGNAL" and "RIGHT FRONT LINEAR ADVANCE SIGNAL") would then be compared to the average of the two main wheel linear advance signals 167 and 168 to determine slippage of any of the front wheels 43. The magnitude of the left and right drive power signals 165 and 166 may be varied pursuant to a variation in the weight of the material deposited in the hopper 16, as may be ascertained from an signal input from a weigh cell function 171 ("WEIGH CELL FUNCTION").

In a contemplated embodiment the power applied to drive the front wheels 43 may be gradually decreased as the weigh cells 123 and 124 indicate a decrease of material retained within the hopper 16. It appears that the front wheels 43, when powered to help advance the paver 10, tend to slip more readily as the material 72 in the hopper 16 is transferred from the hopper to the screed 12, while the power applied to the wheels 43 remains constant. Thus, while a truck is being positioned to dump a new supply of the material 72 into the hopper 16, slip by the driven front wheels 43 may be experienced. Power for the front wheels 43 is therefore advantageously controlled relative to the weight supported by the front wheel assemblies 41 and 42. In a more refined embodiment, readings from the left and right weigh cells 123 and 124 may be applied separately to control the hydraulic motors 46 on the left and right front wheel assemblies 41 and 42, respectively.

In a hydraulic motor, such as the state of the art motors 46 used to drive pavers and similar apparatus, the flow rate of hydraulic fluid through the motor 46 determines the speed at which the motor 46 rotates. Pressure used to force the hydraulic fluid through the motor 46 determines the power with which outer traction surfaces 175 of the wheels 43 (see FIG. 5) seek to maintain their rotational speed. The signal function 171 may therefore be applied to reduce the maximum pressure under which the hydraulic fluid may be supplied to the motors 46 of the driven front wheels 43. It should be understood that other controls, such as known hydraulic circuit controls, may be used to increase or decrease the pressure and fluid volume supplied to the front wheels 43.

Left and right wheel power control functions 177 and 178 are contemplated to be used in conjunction with controlling slip of the front wheels 43 as described herein. Generally, the speed of operation of the hydraulic motors 46 which drive the left and right front wheels 37 and 38, respectively, may be controlled by controlling the amount of fluid pumped through the motors 46. Since hydraulic fluid is incompressible, the volume of fluid passing through the motors may be considered a sufficiently accurate measurement of the linear advance of the paver 10. A timing function 179 ("TIME") may be used to convert either a volume of pumped hydraulic fluid or the angular rotation sensed by the magnetic pickups 48 into a rate of advance of the paver 10. A use of the magnetic pickups 48 is preferred to monitor the rate of advance using the timing signal of the function 179 as a direct speed measurement of the paver 10. Both linear advance and current speed of the paver 10 may in this manner advantageously be provided to an operator at the control console 35.

An incrementally upgraded travel speed of the paver 10 is significant also for automated controls of the paved mat 73. It is known that when the paving speed of the paver 10 is increased, the thickness or depth of the paved mat 73 has a tendency to decrease. Conversely, when the paving speed decreases, the thickness or depth of the paved mat 73 increases. It is believed that because of the comparatively slower forward speed of the paver 10 more of the material across the width of the screed 12 has opportunity to become trapped under the leading edge 51 of the screed 12 for any given distance, thereby increasing the depth of the mat 73.

In accordance herewith it is contemplated to control the depth of the paved mat 73 to maintain the specified grade when speed changes are implemented. The described grade control is expected to make such changes through the operation of the left and right cylinders 65 and 66 so as to substantially control grade changing depth changes of the paved mat 73. However, additionally, when a speed change of the paver 10 is necessitated or is indicated via signals from the distance and time functions 167, 168 and 179, a change in the angle of attack of the screed 12 may immediately be implemented in a manner disclosed hereby, to anticipate a depth change in the paved mat 73. Changes may be made by activating the lead screw mechanisms 58 or the cylinders 65 and 66. Pursuant to such anticipatory changes in the angle of attack of the screed, retroactive grade corrections, which may be implemented after deviations from a desired grade are already measured by the grade sensors 75, 77, may be minimized. Moreover, it appears that with a pro-active change in the angle of attack of the screed 12 the mat 73 may remain of more consistent quality subsequent to a speed change of the paver 10. Such speed changes may be needed to assure the continuity of a paving operation in view of a delay in the continued supply of paving material, or to bring the paving operation to a controlled stop. It is to be understood, however, that in accordance herewith, a more relaxed procedure with respect to control of the paving speed is not contemplated. Instead, the improved controls are used to make such immediate or pro-active changes as are believed to result in an improved quality control over the paved mat 73.

An alarm function 180 ("ALARM") alerts an operator of the paver 10 at the operator's station 36 when an insufficient amount of the material 12 is supplied to the screed 12. The limit switches 31 and 32 which may be contact sensors will provide the alarm function at the control console 35 when an absence of material is detected. A shut-down or controlled stop of the paver 10 may then be implemented by the operator.

7. Automatic Material Supply Controls and Safety Features

FIG. 6 shows somewhat schematically a truck push roll assembly designated generally by the numeral 185. The push roll assembly 185 positions a truck 186 (a rear portion of which is shown) for delivery of the material 72 into the hopper 16. U.S. Pat. No. 5,004,394 discloses among other features a hydraulically operated push roll assembly, the push rolls of which may be positioned to accommodate a distance between the rear edge of a bed of the truck and the rear wheels to position the bed of the truck in a dumping position with respect to a hopper of a paver. In accordance herewith, it is contemplated to provide a number of programmed and stored push roll positions for respective extensions of a bed 187 of the truck 186 beyond the rear of tires 188 of the truck 186 to position the rear of the bed 187 in a preferred position over the hopper 16. For simple identification, the rear of the bed 187 may be provided with a number or identification at 189 which is visible to an operator of the paver 10. The operator may then select a program at the control console 35 to correspond to the identification 189 on the truck 186 as the truck and the paver 10 are approaching each other. The push roll assembly 185 first extends push rolls 191 forward toward the truck until contact between the wheels 188 and the push rolls 191 has been established. The push roll assembly then retracts the push rolls 191 with respect to the paver 10, braking the relative speed between the paver 10 and the truck 186 in accordance with the features disclosed in U.S. Pat. No. 5,004,394. The relative motion between the truck 186 and the paver 10 is completely arrested when the selected programmed position of the rear wheels 188 of the truck is reached to position the rear of the bed 187 in a desired position with respect to the hopper 16 as shown in FIG. 6. In an embodiment including the feature, a movable truck push roll assembly 185 must be present. A slidable guide tongue 192 or its equivalent may be furnished with a position indicator 193 which may be read by one of a plurality of proximity sensors 194 to monitor and control the position of the guide tongue 192. As an alternative, a spring-loaded pull cable and its respective wind-up drum, such as at 195, equipped with an integral angular displacement counter may be attached to the guide tongue 192. With the drum 195 mounted to the paver 10, the extent of release or retraction of cable from the cable drum 195 provides an indication of the longitudinal extent of the push rolls 191 with respect to the hopper 16. As a more complex indicator, presently not preferred, transfer of hydraulic fluid among cylinders (not shown) of the push roll assembly 185 may be used to determine quantitatively the extension of the push rolls 191 with respect to the hopper 16 of the paver 10. Signals obtained from any one of these position indicators of the push roll assembly 185 would be routed to the microprocessor circuit 130 as an input signal for an automated control of the push roll assembly 185 to become positioned to meet a stored position requirement. Since a number of extension programs for the push roll assembly 185 may readily be stored in the memory devices 131, 132 of the microprocessor circuit 130 referred to above, the position control of trucks 186 backing toward the hopper 16 may be readily controlled, subject to the selection of a respective program by the operator of the paver 10. The use of the automated positioning program reduces the amount of attention an operator of the paver 10 needs to pay to the approaching truck 186. Hence, more attention may be given to other operating conditions of the paver 10 with less risk of a defect occurring in the paved mat 73.

A most forward position of the push rolls 191 of the assembly 185 is, of course, limited by operating limits of the assembly 185. Trucks 186 with a truck bed 187 extending farther beyond the rear wheels 188 of the truck have a shorter distance within which the speed of the truck 186 needs to become matched to the speed of the paver 10 than those with a shorter overhang on the bed 187. In both instances the position of the bed 187 of the truck with respect to the hopper 16 is expected to be substantially the same. A shock absorbing feature for the preferred push roll assembly 185 is implemented by a hydraulic accumulator 196 as part of the hydraulic operating system. Details of the system are disclosed in the aforementioned U.S. Pat. No. 5,004,394. In accordance herewith the accumulator 196 is furnished with a variable orifice valve 197 through which the accumulator 196 may be coupled to and be part of a hydraulic positioning system 198 of the push roll assembly 185, the hydraulic positioning system being identified schematically in FIG. 6.

The push roll assembly 185 also shows hitches or truck hooks 201 which are pivotally mounted at laterally outer edges of the push roll assembly 185 to latch into the wheels 188 when the truck 186 is in contact with the push rolls 191. The truck hooks are shown in an open position, pivoted out of the way of the wheels 188 as they may have moved into contact with the push rolls 191. The truck hooks 201 may then be engaged or moved to a truck engaging or closed position by a pivotal movement toward each other and the adjacent rear wheels 188 of the truck 186, in the direction as indicated by arrows 202. Pursuant hereto it is contemplated to provide an interlock arrangement which inhibits the truck hooks 201 from moving or being moved to a closed position when the truck 186 is not in contact with the push roll assembly 185. Truck hooks 201 may not always be used in conjunction with a push roll assembly 185. Generally, though, the use of the truck hooks 201 becomes desirable, if not necessary, in hilly country when a paving operation may proceed along a descending grade. While the truck 186 may engage the paver 10 under power, it is generally desirable to allow the movement of the paver 10 to control the joint advance of the truck 186 with the paver. With the drive gears of the truck preferably remaining in neutral while the paving material is dumped by the truck into the hopper 16, the truck driver would need to apply brakes during a downhill paving operation to retain the truck 186 in contact with the paver 10. Uneven application of the brakes may cause excess forces to be transmitted from the truck through the paver to the screed 12 to cause defects in the paved mat 72. It is under the latter paving conditions that the use of truck hooks 201 becomes desirable.

An extension indicator of the push roll assembly 185, such as the described position cable drum 195 or the sensed position indicator 193 may be employed in providing an arrangement to selectively engage or disengage the truck hooks 201 from the wheels 188. In accordance herewith, a hook closing and hook opening toggling action may desirably be operated at a full forward extension of the push rolls 191 after an intervening, at least partial, retraction of the push rolls 191, or on an increase of pressure in the accumulator 196 over and above a minimum precharge or preloaded pressure therein. A pressure sensor 203 mounted through the accumulator 196 may be coupled to the previously described microprocessor circuit 130 to provide a pressure indication, particularly a signal of an increase in pressure over a preload pressure, as it would occur when the truck wheels 188 make initial contact with the push rolls 191.

If the truck hooks 201 are initially open during the full extension of the push roll assembly 185, an indicated pressure increase in the accumulator would, accordingly, toggle the truck hook toggle in the microprocessor circuit 130. The microprocessor circuit 130 hence activates the truck hooks 201, through generally known hydraulic actuators, not separately shown, to close the truck hooks and engage them with the truck 186. The previously selected positioning choice for the push roll assembly 185 can now proceed to retract the push rolls to the predetermined optimum position for the particular truck 186. A resulting partial retraction is sensed by the cable drum 195, for example, the drum 195 sending a corresponding signal to the microprocessor circuit 130 which sets the truck hooks 201 to automatically open upon the next full forward extension of the push roll assembly 185. The opening of the truck hooks 201 to release the truck 186 may be used with an appropriate time delay or a required intermediate retractive movement of the push roll assembly 185 to again set the truck hook toggle to close on a subsequent pressure increase in the accumulator 196. Of course, various modifications may be made in the process of automatically closing and opening the truck hooks 201, or in the apparatus to achieve such automatic operation of the push roll assembly 185 with or without the truck hooks 201. In accordance herewith it may also be desired to selectively disable the automated truck hook operating arrangement 201 as a safety feature.

Further in reference to FIGS. 1, 7 and 8, other safety interlocks are desirably resident within the control console 35. For example, the microprocessor circuit 130 may operate under a control program resident in the memories 131, 132 (see FIG. 7) which includes selectively activated safety functions. Accordingly, the microprocessor circuit generates control signals which disable otherwise available operator functions whenever these functions become unsafe or dangerous during certain operating modes of the paver 10. The generation of disabling control signals is generally conditioned on status signals analogous to those already described herein in reference to FIG. 7, for example. In addition, the operation of the engine 44 may be indicated by an engine revolution counter, or by other convenient indicators. When the engine 44 is already operating, the engine starter, not separately shown but being part of and coupled to the engine 44, is preferably disabled. Also, a paver travel range shift which generally permits an operator to shift the paver between slow, fast and reverse travel ranges may be selectively disabled. For example, when the paver 10 has been shifted to a high travel range and is traveling at a high speed in that range, a blocking function is initiated to prevent an operator at the operator's station 36 from engaging the low travel range of the paver 10, such as by moving a range shift lever 205. A cause for a sudden change in speed which might cause a jerky movement of the paver is thereby eliminated. A paver speed signal provided by the functions 167, 168 and 179, as described above, provides a status input in a comparison check by which the range shift blocking function is implemented. Current speed data are compared to stored data on blocked out speed ranges. On the basis of the comparison the microprocessor circuit 130 generates the shift inhibiting function. The blocking signal generated by the microprocessor circuit may also be programmed to block the shift lever 205 from shifting the paver into reverse when the screed 12 is in an operative down position.

8. System Architecture

Though the described control features simplify the operation of the paver 10, it is generally preferred to operate the paver 10 as two separate, major units of a paving system 10. Thus, in general, a paving job may be performed by a tractor operator who operates the tractor unit 11, and a screed operator who is responsible for the setup and proper operation of the screed 12. Though each operator performs functions separate and distinct from those of the other, it will be understood by those skilled in the art that close cooperation between the tractor operator and the screed operator is considered necessary. Pursuant to the objects of improved control, cooperative interaction between the tractor operator and the screed operator is sought to further facilitate the operation of the paver 10.

Figure 9:
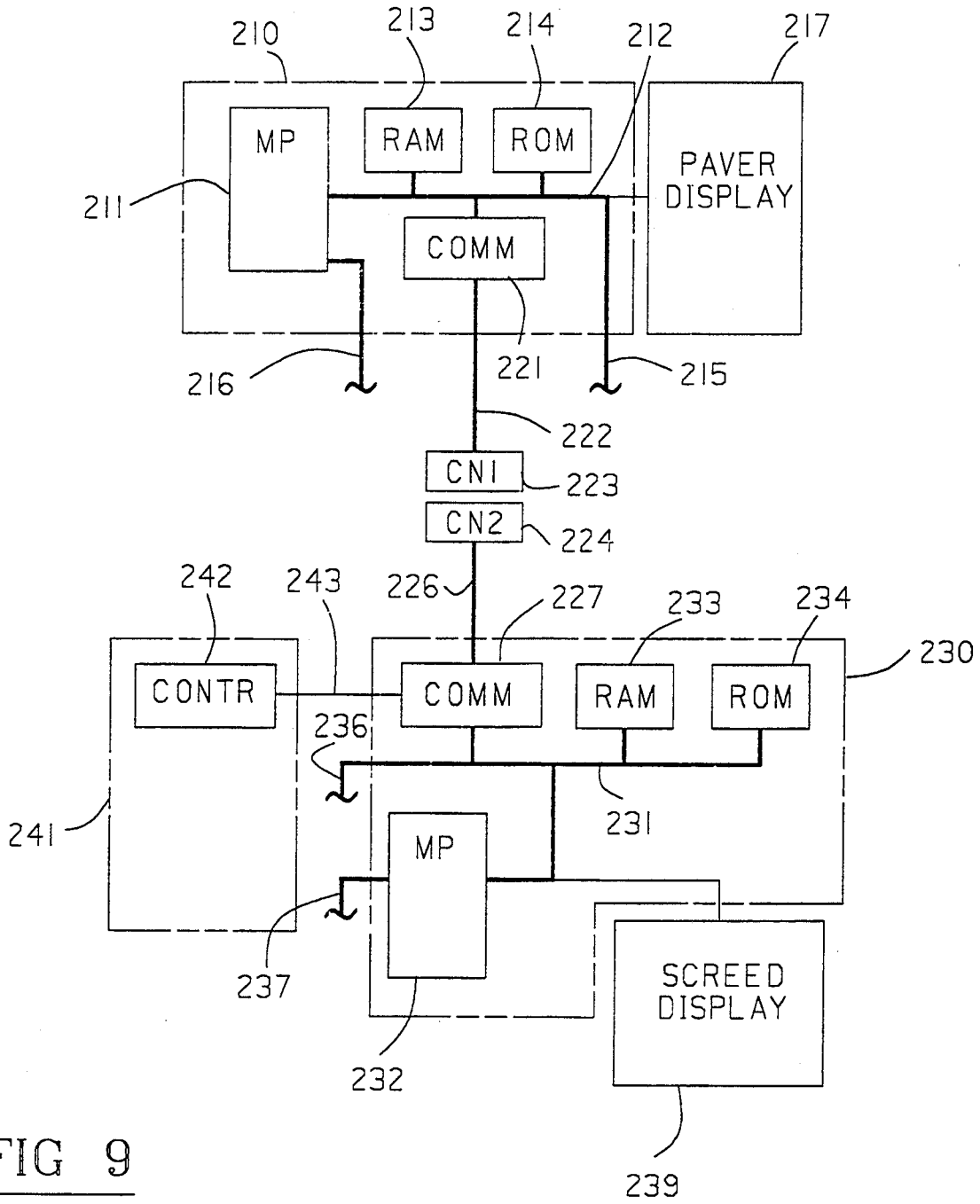
FIG. 9 is a block diagram showing another embodiment of the control circuit of the paver, a further, separate control circuit of a screed of the paver and a communications link interconnecting the two control circuits.

Referring to FIG. 9, a schematic diagram shows a somewhat altered embodiment of the already described structure and control functions (see FIG. 8). A microprocessor circuit 210 which is functionally similar to the microprocessor circuit 130 described in reference to FIGS. 7 and 8. The microprocessor circuit 210 includes a microprocessor circuit device 211 ("MP") which is coupled via data and address buses shown schematically as a bus 212 to typical operational memory, represented by the memory device 212 ("RAM"). Control code may be stored in a read-only masked memory device 214 ("ROM") or any equivalent static memory device. A communication bus 215 may be coupled to receive the control input signals as described herein. A control signal output bus 216 would also be coupled to drive the control functions in the manner described herein, or to drive existing prior art paver and screed controls. The microprocessor circuit 210 is further coupled to a display screen function 217 ("PAVER DISPLAY"). The display screen function may physically include a well known LCD screen 218 (see FIG. 9) or an electrically equivalent screen. The display screen function 217 is desirably capable of displaying alphanumeric characters. This permits numerical data as well as short prompt or cautionary messages to be displayed to an operator.

Further in reference to FIG. 9, the microprocessor circuit 210 further includes a communication circuit or communication interface 221 ("COMM") which is an I/O (input-output) interface circuit being coupled to a communications cable 222. The communications cable 222 is preferably a shielded combination data and power communications cable, which includes data lines for transmitting control signals and electrical power lines which transmit electrical power. The cable 222 is preferably coupled through a connector element 223 ("CN1"), a mating connector element 224 ("CN2") and further through a second, communications cable 226 to a communications interface circuit 227 ("COMM") of a second microprocessor circuit 230. The second microprocessor circuit 230 is a controller which is located on the screed 12. Data and address bus 231 couples the screed communications interface circuit 227 to a second or screed microprocessor 232. The microprocessor 232 is further coupled to typical random access or operational memory 233 ("RAM") and typical permanent memory 234 ("ROM") wherein the control code for the screed microprocessor 232 is stored. The microprocessor circuit 230 may further include data communications input and output lines which are generally indicated by data buses 236 and 237. It is understood that selected ones of the described control signals or functions may be coupled via the data buses 236 or 237 and via the screed microprocessor circuit 230 and the cables 222 and 226 to the microprocessor circuit 210. For example, a screed slope error signal function 150 may be coupled to the microprocessor circuit via the bus 215 or via a corresponding bus 236 of the microprocessor circuit 230. Corresponding operating instructions would differ to instruct the microprocessor 211 of the path for obtaining the signal 150 (see FIG. 7).

Figure 11:
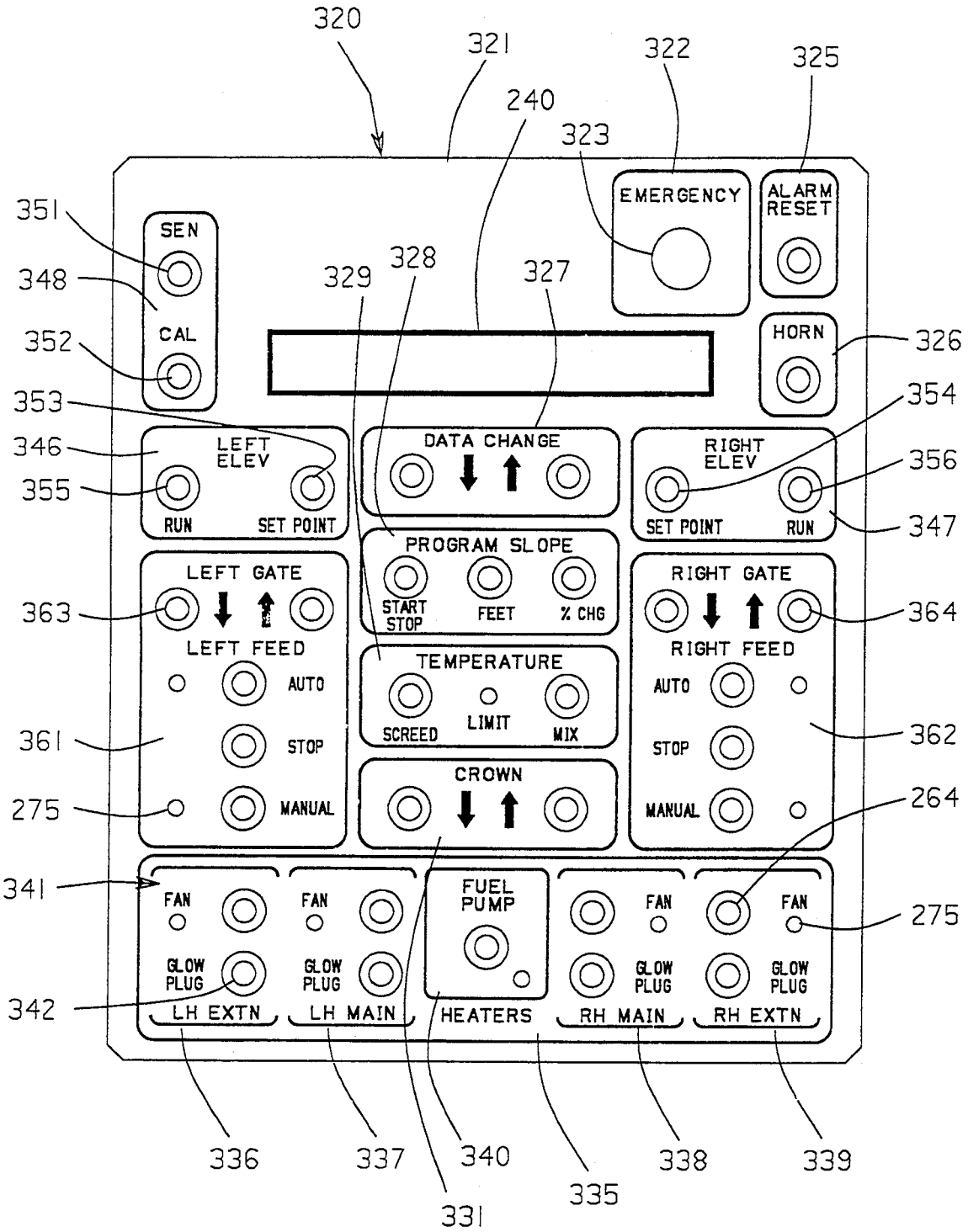
FIG. 11 is a particular embodiment showing a screed control panel with set up and operating control functions under the control of a screed operator.

The bus 231 of the screed microprocessor circuit 230 is also coupled to a display screen function 239 ("SCREED DISPLAY"). The display function 239 and a corresponding display screen 240 as shown in FIG. 11, for example, is preferably controlled to mirror selected screed functions of the alphanumerical screen display shown on the control console 35 of the tractor unit 11 of the paver 10. It is by duplicating certain functions and respective display indications, either the tractor operator or the screed operator may control the duplicated functions. Electrical control signals communication via the cables 222 and 226 provide both the tractor operator and the screen operator with the capability to exercise control over the selected screed functions.

Figure 12:
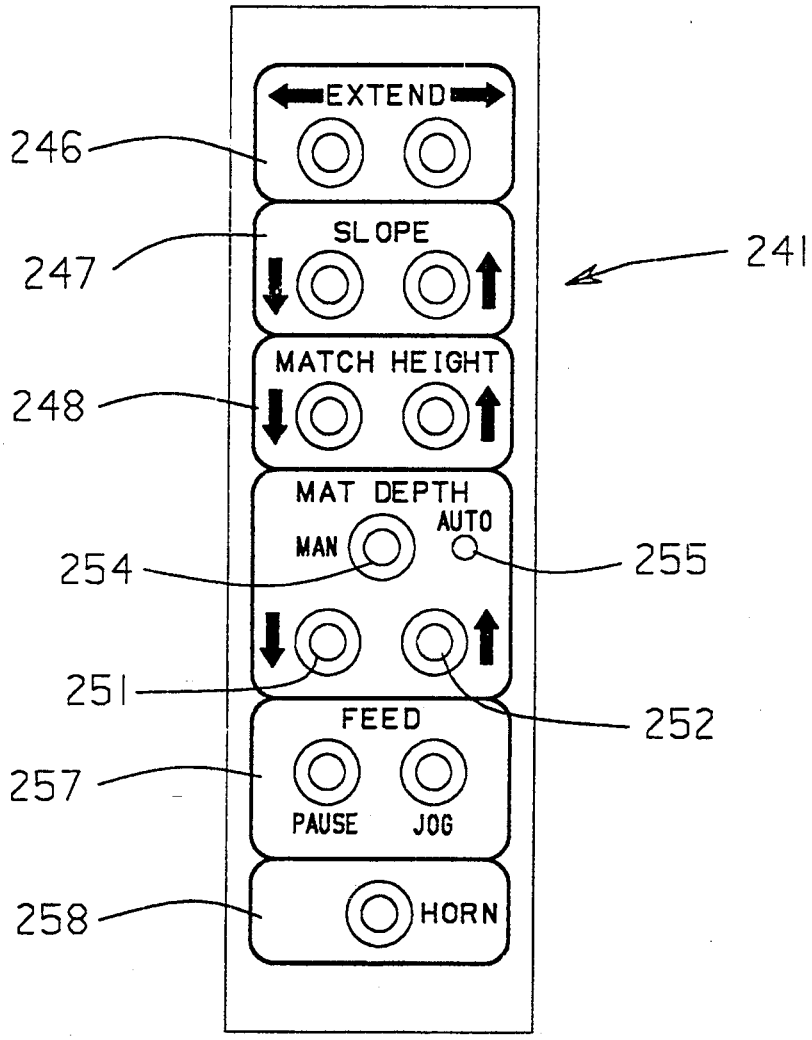
FIG. 12 is a particular embodiment of a remote control unit for use by a screed operator.

It is found convenient to maintain an external, detached or semi-detached access device to permit a screed operator to control selected screed functions in a manner similar to that of current practices in the art. Thus, a hand-held remote control unit 241 includes screed control functions 242 which are schematically represented by the function block 242 in FIG. 9. The control function 242 is coupled via a communications link 243 to the microprocessor circuit 230. Typically, the communications link 243 has been a cable 243 which may be a resiliently coiled cable, hence one that will extend and contract as needed. It should be understood that other communication links 243 may be available which may not require a cable as a link 243, but may use other means, such as RF transmissions, for example. FIG. 12 depicts as a preferred example the remote control unit 241. Typical functions of the screed may be controlled by an operator as the operator walks next to the paver 10. Such functions may be a transverse screed extension function 246, a slope control function 247, matching the height of the mat 73 to an existing mat, as shown by the control function 248, control of the depth of the mat 73, indicated by separate up and down buttons 251 and 252, respectively and an automatic control activation button 254, an indicator, such as an LED indicator 255 is disposed adjacent the automatic button 254 to indicate when automatic mat depth control is in effect. Further included in the remote control unit 241 may be a material feed control 257 and a horn 258, to sound a warning or alert signal. A presently preferred embodiment provides generally push buttons for executing the described functions, as shown by the representative push buttons 251 and 252. Push button functions may be continuous for the duration of activation of the respective push button, such as a down push button 251 which would decrease the mat depth, or it may be a momentary switch button, which momentarily switches a function and then becomes deactivated, such as the push button 254 which toggles the depth control between a manual and an automatic control state. It is understood in the art that functions implemented by the remote control 241 are those which a screed operator may activate while walking next to the paver 10.

Figure 10:
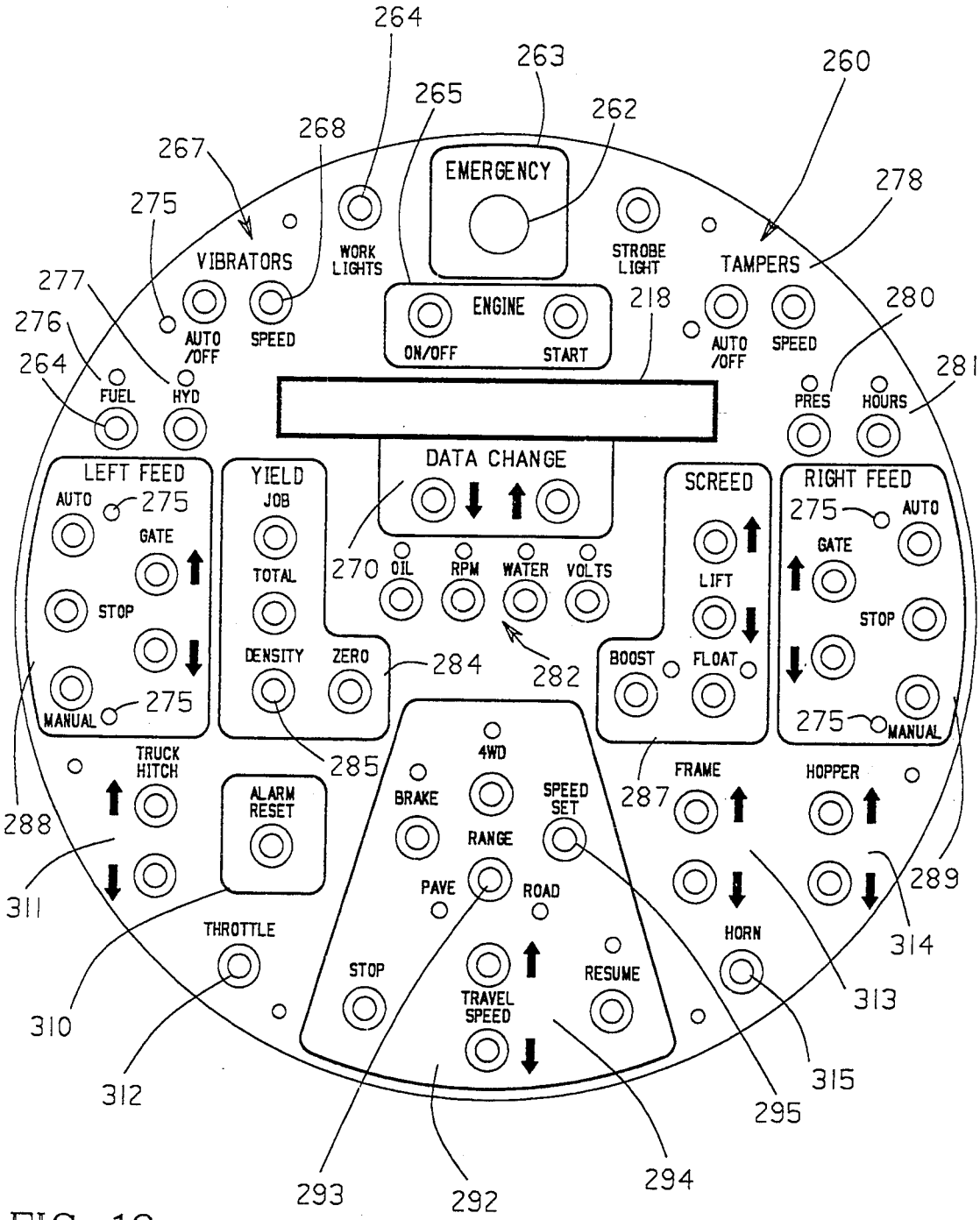
FIG. 10 is a particular embodiment of a control panel with control functions under control of a tractor operator.

FIG. 10 shows a diagram of a preferred embodiment of a control panel 260 of the operator's console 35 of circular shape and particularly chosen in that shape to fit within a steering wheel 261 (see FIG. 1) of the tractor unit 11. In general, various functions accessible through the control panel 260 are preferably implemented by push buttons, such as the previously referred to buttons 251, 252. Certain functions remain activated while a respective push button is held down or engaged. Other functions require an engagement and release for a single toggle function to occur.

At the top of the panel 260 is a large, red emergency button 262 disposed in a functional panel area 263 which is labelled "EMERGENCY". The button 262 differs in size and function from other push buttons 264 which are used to implement other functions on the panel 260. The emergency button 262 is a combination of an emergency stop button and a reset knob. Pushing the emergency button 262 stops all active modes of the paver 10 and even stops the engine. After an emergency stop, a reset needs to be activated. A reset function may be activated by turning the emergency button 262. Distinct functional operations are designated in select areas of the panel 260. In the following description, certain functions are summarily described by functional assignments rather than describing all functional occurrences. It should be understood that there are certain functions that may be changed to accommodate preferences. The microprocessor circuit 210, for example, allows programmed changes with little physical alteration, except for label changes to accommodate special functions. The same push buttons 264 may be used throughout to either step through various data access states or to activate functions. In each case a physical function of the push button switch is that of a contact closure. The logical result is that of electrical function controlled by the microprocessor circuit 210, for example.

Further in reference to FIG. 10, located beneath the emergency function 263 is an engine on/off and start function 265. It should be understood that an on/off button would function as a toggle between alternate states, replacing a key-type rotational switch, for example. A start button on the other hand would be a push to engage function. Unless they depart from such commonly understood operational functions, the various pushbutton functions are not separately explained herein below. A vibrator control 267 includes an Auto/off toggle and a speed control function 268. Pushing the push button 264 of the speed control function 268 displays the vibrator speed on the display screen 218. Once data are displayed on the screen 218 or 240, for that matter, a "data change" function may be activated by holding down either a "down" button or an "up" button, as indicated in the functional panel area 270. The data change function would generally be applicable for all monitored functions that may be displayed on the display screens 218 or 240 or both.

The upper region of the panel 260 also includes a push button 264 for "work lights" and for "strobe lights". The functions are toggles and are self explanatory. In a presently preferred embodiment, the single light function button is a three-way toggle which toggles sequentially through "low beam," "high beam," and an "off" position. Again, these sequences are not mechanical sequence switching actions, but are electronically cycled in response to each mechanical closure of the respective push button switch 264. These functions, therefore, may readily be altered with little or no mechanical alterations.

Indicator diodes 275 may be mounted in the panel 260 adjacent selected function buttons. Certain indicator diodes 275 are status indicators. When the status indicator diodes 275 are lit, the functions are shown as being activated. There are other indicator diodes 275 which do not indicate an "on" state of the related function but signal a warning of an undesirable condition or status. Generally the indicator diodes 275 may be described as "status warning indicators". Thus, when the lights are turned on by a push button toggle operation, the activation of the respective diode 275 warns of the active state of the function. Other status warning signals may constitute an "out of range" warning. Fuel and hydraulics functions 276 and 277, respectively, include indicator diodes 275 which will light up, for example, respectively, when fuel supply runs low, below a predetermined and set reserve, and when hydraulic pressure exceeds of falls below a preset acceptable range. Pressing the respective function button will display the present data values of the activated function on the display screen 218. A single button may cycle through a relatively large number of display variables. For example, the hydraulic pressure indication may move through a cycle of ten different indications of maxima and minima of various hydraulic systems.

A material tamper function 278 is typically associated with operating the screed 12, but is in the described embodiment under the control of the tractor operator. The tamper function 278 would typically be activated and may generally be operated automatically, to provide a uniform power input to the paving process.

A "pres" function 280 provides monitoring of hydraulic and engine pressure conditions. Other engine status functions are disposed beneath the data change panel region 270. "Hours" is a monitoring function 281 which tracks operating hours and is preferably cycled to recall accumulated hours of operation and accumulated hours of operation with the screed down. These records may be deemed useful for scheduling preventive maintenance as well as for accounting for paving costs on particular paving jobs. Other engine functions, designated generally by the numeral 282, function to monitor oil temperature, engine speed, water temperature and battery and electrical generation.

The "data change" function is contemplated to be used in conjunction with one of the other functions. Activating a respective function to display data on the display screen 218 and pressing a button adjacent either the "up" arrow or the "down" arrow would permit the displayed value to be correspondingly changed in predetermined increments.

A yield monitoring function 284 may be used to maintain a record of the total amount material paved by the paver 10, as well as the material throughput of the paver 10 on a particular job or during a particular time segment on a total job. A density function 285 permits a weight per volume of material to be entered or altered by activating the function 285 together with the data change function 270. On the right side of and next to the data change function 270 are basic screed positioning (raising and lowering) functions 287. When lowered, the screed may be placed into a float condition in which the screed 12 floats with its entire weight on the paved mat 73 (see FIG. 5), or the screed may be placed into a boost condition in which the screed rests on the mat 73 as in a float condition, but at least a major portion of the weight of the screed 12 is removed from the screed by application of hydraulic pressure. Neither float nor boost conditions may be activated while the paver 10 is in a travel range.

To the outer left of the yield monitoring function 284 and to the right of the basic screed positioning functions 287 are left and right material feed and distribution functions 288 and 289, respectively. By the left and right material feed and distribution functions 288 and 289, the speed of the left and right material conveyors 17, 21 and 18, 22, respectively, and the height of the left and right flow gates 23 and 24 may be adjusted or controlled. The height of the flow gates 23 and 23 may be controlled directly, as shown by the respective "up" or "down" arrows. The conveyors may be operated in an automatic condition wherein the feed speed is adjusted automatically based on usage. Either one of the indicator diodes 275 will light to indicate either an "Auto" or a "Manual" status.

A primary paver control function panel region 292 contains major paver control functions, such as range shift 293 with indicator diodes indicating when the paver 10 is either in the pave or in the road speed range. Within a set range, paver speeds may be adjusted directly by travel speed adjustment functions 294, either "up" or "down" as indicated graphically by respective arrows. A "speed set" function 295 may be used to preset a desired paver speed when the paver is in the paving mode. The set speed will not be activated in the "road" or travel range, as opposed to the paving range. Data change buttons may be used to change a preset paving speed. A "resume" function will advance the paver speed to the preset speed, while a change through the speed change function 294 will change the paver speed with respect to the preset value. The paver may also be stopped at any time by pushing the "Stop" function. When the paver 10 is placed into the stop position, the tow point cylinders 65 and 66, screed vibrators (not shown) and the material feed conveyors 17, 18, 21 and 22 will be shut down. The preset value may however be resumed by pushing the resume button.

Paver accessory functions are located to the left and right sides of the primary paver control function panel region 292. An alarm reset function 310 may be used in conjunction with removing alarm conditions after they are displayed on the screen 218. A truck hitch engage and disengage function 311 may be used to engage truck hooks and restrain material supply trucks. Modifications of the displayed simple truck hook arrangement are possible in accordance with the above description relating to the push roll assembly 185. A throttle function 312 may be activated to switch the throttle position of the engine of the paver between an idle and a full power position. On the right hand side of the panel 260, there are located such functions as a frame raising and lowering function 313, a hopper wing positioning function 314, and a horn 315. The frame raising and lowering function as such is known in the art and does not form part of the invention. The frame raising and lowering feature 313 of the paver 10 may be applicable particularly to tractor units 11 which are propelled by wheels as opposed to those propelled by endless tracks. The hopper wing positioning function 314 in a presently preferred embodiment as shown in FIG. 10 would contemplate raising and lowering both hopper wings 26 and 27 simultaneously. However, it is further contemplated in accordance with the description of the features hereof to independently raise either the left or the right wing 26 or 27 to attempt to shift material within the hopper from one side of the paver 10 to the other. Because of the electric contact feature of the push buttons 264, it is readily within control functions of the control console 35 to toggle the operation of the wing positioning function 314 through activation of either left, right or both wings of the hopper 16.

In reference to FIG. 11, a screed control box designated generally by the numeral 320 has a control panel 321 located on a frontal side of the box. A currently preferred position of the screed control box 320 is on the screed 12, as is shown in FIG. 3. The screed control box 320 and the functions on the display panel 321 may, however, be located on the tractor unit 11 adjacent or incorporated into the control console at numeral 35 (see FIG. 1), instead of on the screed 12. It may be particularly advantageous to locate a first one of the control boxes 320 on the screed 12 and a second control box with duplicated control functions as part of the control console 35 (see FIG. 1). Accordingly, microprocessor circuit 210 in FIG. 9 typical electronic wiring harnesses interconnect a second, identical microprocessor 230 with the microprocessor circuit 210. An addition of a second microprocessor circuit and a second screed control panel 321 on the tractor unit 11 permits the operation and control of the screed 12 from both the screed 12 and from the tractor unit 11. Thus, only in a current embodiment of the invention is the control panel 321 disposed at the screed 12. Other or additional locations for placing the screed control box 320 are clearly within the scope of the disclosure herein.

In FIG. 11, an "Emergency Stop" function 322 duplicates the emergency function 263 described with respect to the panel 260 in FIG. 10. The operation of the button 323 and the reset action associated therewith are also the same as that of the button 262. Other push button switches used on the panel 321 are the same as the push button switches or activators 264 described with respect to the control panel 260. An "alarm reset" function 325 when activated turns off any audible or visual alarm indicators while the alarm indication is active. During such time the status of the alarm condition would be displayed on the display screen 240. The "horn" function 326 is identical to the horn function 315 shown in FIG. 10. The horn function 326 sounds the horn when pressed. The "data change" function 327 located beneath the display screen 240 has the same function as the data change function 270 of the control panel 260. The respective "up" or "down" buttons are pressed in conjunction with another status button, such that status data displayed on the display screen 240 may be changed in predetermined increments, while any change may be visually confirmed or controlled by viewing the screen 240.

A program slope function 328 may be used to set a change in slope as a function of linear advance of the paver 10 in a manner described above. The push buttons associated with the control panel function 328 are used in setting up a programmed slope change, when, for example, the paver 10 is advancing into a curve of a roadbed to be paved. The three push buttons displayed in the panel space of the function 328 permit first of all a programmed slope to be turned on or turned off, hence initiated and then stopped when a desired slope is reached. A second button causes a linear advance over which the programmed slope is to occur to be displayed. A third button provides for the display of a slope variable. Holding either of these latter two buttons permits displayed values to be changed by the data change function 327. A "temperature" display function 329 provides for measured screed and paving material temperatures to be displayed. Alarm limits for the screed temperature are preferably predetermined and non-adjustable below the deterioration temperature of the asphalt material. Push buttons of the temperature display function 329 toggle a respective screed and material temperature display on or off. A screed "crown" function 331 is located below the temperature display function 329. The "crown" function 331 provides for shaping or removing a center crown in the screed 12. The use of a central angular upward bend in a transverse plane of the screed is well known in the art of paving. The resulting crown effect is used, for example, when single path paved strips are specified to have transverse drainage slopes to both sides.

A lowermost portion of the panel 321 has been allocated for a burner control function 335. The panel layout of the burner control function 335 preferably provides for four independent burner units which may be mounted on left and right main screed sections and left and right screed extensions which may be used outside of the respective main screed sections of the screed 12, as it is well known in the art. The burner control function 335 consequently locates the respective burner controls 336 through 339 to correspond to the physical arrangement of burner units in a transverse direction across the width of the screed 12. A central "Fuel Pump" button and status indicator diode is used to toggle the fuel pump to burners between an "on" and an "off" position. Any of the four "fan" push buttons 264 preferably have an indicator diode 275 associated therewith. The "fan" respective functions 341 toggle would toggle heater fans "on" and "off", the respective diode 275 indicating an active state of a heater fan. "Glow plug" functions are engaged only while a respective push button 264 is being held down.

To the left and right sides of the "data change" function 327 there are located, respectively, left and right automatic grade and slope control functions 346 and 347. The automatic grade and slope control functions 346 and 347 are used in conjunction with a sensor monitoring and calibration function 348, which has been located in an upper left and corner of the panel 321. Respective sensor sensitivity, sensor calibration, and left and right set point calibration functions 351, 352, 353 and 354 are made in conjunction with the data change function 327 while monitoring the displayed respective values on the display screen 240. Left and right "run" functions 355 and 356 toggle grade and slope controls of the paver 10 between automatic and manual operational modes.

Below the left and right automatic grade and slope control functions 346 and 347, there are located left and right material feed and distribution functions 361 and 362. The left and right functions 361 and 362 are located logically arranged on the left and right side of the panel 321, respectively. The functions 361 and 362 parallel and duplicated the corresponding material feed and distribution functions 288 and 289 on the panel 260. Respective buttons 264 of the gate height control functions 363 and 364 are also marked by respective "up" and "down" arrows to identify the particular function of a respective button. In the same manner as the functions 288 and 289, feed and distribution functions 361 and 362 may be toggled between automatic and manual material feed, and may be stopped by activating a corresponding button 264.

The remote control 241, in contrast to the screed control box 320 may advantageously eliminate all presently preferred screed setup functions which may be activated through the control panel box 320. At the same time it should be understood, the described functions are those found in a currently preferred layout of control panels 260, 320 and 241. One advantage of dividing paver set up and operating functions into those which are generally performed by an operator of the tractor unit and into those that are generally performed by a screed operator, and of duplicating material feed and distribution functions on both the tractor unit 11 and the screed 12 is a savings in time and cost. The described assignment and duplication of functions is believed to save assembly and set up times by permitting the screed 12 and the tractor unit to be serviced as separate units. At the same time, critical operations may be shifted between a tractor operator and a screed operator because of the described interconnection between the control panel 260 and the screed control box 320, as shown in FIG. 9.

Various other changes and modifications in the structure of the described embodiments are possible without departing from the spirit and scope of the invention.

What is claimed is:

1. Paving apparatus comprising:

a tractor unit;

a paving screed having a width extending transversely across a width of a path to be paved, the screed coupled by left and right pull arms to the tractor unit to be pulled by the tractor unit, left and right pull arm positioning actuator devices coupled to the tractor unit and to the pull arms, the actuator devices operable to orient the screed at an angle of attack with respect to the direction of travel of the tractor unit at respective left and right sides thereof;

material transfer conveyor means having at least one conveyor track extending from the front to the rear of the tractor unit and left and right transverse material distribution conveyors disposed transversely to a direction of travel of the paving apparatus and in front of the screed to distribute material across the width of the screed;

grade control sensing means including means for sensing the height of the screed with respect to a grade reference and means for measuring travel of the tractor unit; and a control device including a screed position control means for controlling the angle of attack of the screed based on a magnitude of a height deviation of the screed with respect to the grade reference within a unit of measured travel of the tractor unit.

2. Paving apparatus according to claim 1, wherein the grade control sensing means further includes slope control sensing means including means for sensing a transverse slope of the screed, and wherein the control circuit includes means for controlling a magnitude of twist in the screed including means for converting a determined magnitude of deviation of the transverse slope of the screed from a predetermined reference slope to a vertical deviation of one transverse side of the screed with respect to the other and for computing a corrective twist angle based on the vertical deviation over a unit of measured travel of the tractor unit.

3. Paving apparatus according to claim 1, wherein the control device comprises means for sequentially obtaining height data from the grade control sensing means and for comparing the height data to a grade reference, for sequentially determining a distance advanced by the tractor unit between two sequentially obtained height data, for determining a projected angle of vertical deviation of the screed from a predetermined path of advance of the screed over a unit of measured travel of the tractor unit, and for applying a correction to the angle of attack of the screed which offsets the projected angle of vertical deviation.

4. Paving apparatus according to claim 1, wherein the means for controlling the angle of attack of the screed based on a magnitude of a height deviation of the screed with respect to the grade reference within a unit of measured travel of the tractor unit comprises a means for determining an angle of deviation of the angle of attack of the screed with respect to a predetermined angle of attack of the screed to retain the screed at the grade reference, and means for controllably changing the angle of attack of the screed with respect to the grade reference with an angular change offsetting an angle of deviation of the screed with respect to the grade reference in the direction of advance of the tractor unit, the angle of deviation being defined by the magnitude of the height deviation of the screed over the unit of measured travel.

5. Paving apparatus according to claim 4, wherein the grade control sensing means comprises means for sensing a position of at least one of the pull arms with respect to a grade reference.

6. Paving apparatus according to claim 4, wherein the grade control sensing means comprises means for sensing a position of at least one of the pull arms with respect to a grade reference and means for determining a difference value in angular orientation of one of the pull arms with respect to the other.

7. Paving apparatus according to claim 4, wherein the grade control sensing means comprises a first grade reference sensor disposed at a first side of the screed transversely offset from the screed with respect to the line of travel of the tractor unit, and a second grade reference sensor disposed on a respective one of the pull arms on the first side of the screed at a predetermined distance forward of the position of the first grade reference sensor, and means for determining an angular orientation of the pull arm on a second side, opposite from the first, with respect to an angular orientation of the pull arm at the first side of the screed.

8. Paving apparatus according to claim 7, wherein the means for determining an angular orientation of the pull arm on a second, opposite side of the pull arm on the first side of the screed comprises means for determining a slope of the screed transverse to the direction of travel of the tractor unit, and a slope sensor means, disposed on the left and right pull arms and at a predetermined distance in front of the screed, for determining a slope between respective positions of the pull arms at the predetermined distance in front of the screed and for comparing the slope between positions of the pull arms with respect to the transverse slope of the screed.

9. Paving apparatus according to claim 7, wherein the means for determining an angular orientation of the pull arm on a second, opposite side of the pull arm on the first side of the screed comprises first and second slope sensors mounted on the pull arms on the first and second side of the screed respectively and oriented to indicate a slope of the respective pull arms with respect to the horizontal in the direction of travel of the tractor unit.

10. Paving apparatus according to claim 1, wherein the means for sensing the height of the screed with respect to a grade reference comprises at least one grade reference sensor disposed adjacent the screed and transversely offset with respect to the direction of travel of the tractor unit on at least one side of the screed.

11. Paving apparatus according to claim 2, wherein the slope control sensing means comprises a slope sensor disposed at and mounted to the screed to measure a slope of the screed transverse to the direction of travel of the tractor unit, and means for determining the angular orientation of the pull arms with respect to each other.

12. Paving apparatus according to claim 11, wherein the means for determining the angular orientation of the pull arms with respect to each other comprises a second slope sensor mounted across the pull arms at a predetermined distance forward of the screed.

13. Paving apparatus according to claim 11, wherein the means for determining the angular orientation of the pull arms with respect to the direction of travel of the tractor unit comprises a slope sensor mounted to each of the pull arms and oriented to measure the angular orientation of the respective pull arm with respect to the direction of travel of the tractor unit and the screed.

14. Paving apparatus according to claim 1, comprising a material receiving hopper disposed at the front end of the tractor unit and in communication with the material transfer conveyor means, and a push roll assembly disposed at the front end of the tractor unit and longitudinally extensible in the direction of travel of the tractor unit, and a sensor disposed on the tractor unit adjacent the push roll assembly, the sensor coupled to the control device and operable to sense the extension of the push roll assembly with respect to the paver, and means coupled to the control device for operating the control device to generate control signals to control the extension of the push roll assembly into one of a plurality of extended positions, whereby a material delivery truck having a unique extension of a rear end of a truck bed beyond rear tires of the truck can be positioned with the rear end of the truck bed over the material receiving hopper upon the push roll assembly having been extended to a correspondingly unique extension position of the push roll assembly.

15. Paving apparatus according to claim 14, the push roll assembly further comprising truck hooks for retaining the wheels of a truck in position against the push rolls of the push roll assembly, and sensing means for sensing the contact of the truck wheels with the push rolls and means for engaging the truck hooks with the respective truck wheels upon a sensed indication that the truck wheels are in contact with the push rolls, and means for releasing the truck hooks upon the push roll assembly extending to a fully extended position.

16. Paving apparatus according to claim 1, wherein the tractor unit comprises rear main drive wheels, a material receiving hopper disposed ahead of the main drive wheels at a front end of the tractor unit and in communication with the material transfer conveyor means, the front end of the tractor unit being movably supported by front wheel assemblies, the front wheel assemblies including at least one front wheel on each side of the tractor unit, means for driving at least one front wheel on each side of the tractor unit separately from the main driving wheels, means for sensing a linear travel distance of the driven front wheels, means for comparing the linear travel distance of the front wheels with a distance travelled by the tractor unit to determine front wheel slip, and means for changing the power applied to the driven front wheel upon a slip of the front wheel being determined by the means for comparing the linear travel distance of the front wheels.

17. Paving apparatus according to claim 16, including means for weighing a load supported by the front wheel assemblies and means for changing the power applied to the front wheels in response to a change in a load supported by the front wheel assemblies.

18. Paving apparatus according to claim 1, wherein the control device further comprises:

first control panel means disposed at an operator's console of the tractor unit and including a first display screen, a first control circuit and first operator controls, for operating the tractor unit and for controlling at least selected functions of the paving screed;

second control panel means disposed at the paving screed and including a second display screen, a second control circuit and second operator controls, for operating and controlling functions of the paving screed; and means for selectively coupling the first control panel means communicatively to the second control panel means, whereby control data may be transferred between the first and second control panel means and control data pertaining to the control of the paving screed may be displayed at the operator's console of the tractor unit, and the first and second control panels are further capable of operating independently of each other to indicate on the first and second display screens operational data of the tractor unit and operational data of the paving screed, respectively.

19. Paving apparatus comprising:

a paving screed having a width extending transversely across a width of a path to be paved;

at least one grade sensor mounted fixedly with respect to the paving screed outboard of and at the paving screed to sense a height of the paving screed with respect to a grade reference, the grade reference being indicative of a grade of a pavement to be laid down along the path to be paved;

means for advancing the paving screed in a direction of advance along the path to be paved;

means for positioning the paving screed at an angle of attack in the direction of advance, the angle of attack being positionable over a range including an set angle of attack for the paving screed to lay pavement at a height specified by the grade reference;

sensor means for determining the angle of attack of the paving screed with respect to the grade reference;

means for determining consecutive intervals of advance of the paving screed along the path to be paved;

means for computing an angular deviation of the paving screed within a determined interval of advance of the paving screed as a deviation of height of the paving screed with respect to the grade reference over the determined interval of advance; and means for controlling the paving screed positioning means to apply a correction to the angle of attack of the paving screed based on a computed angular deviation of the paving screed during a determined interval of advance of the paving screed.

20. Paving apparatus according to claim 19, further comprising:

means for determining a transverse slope along the width of the paving screed with respect to a horizontal and for comparing the determined transverse slope to a specified reference slope, to determine a transverse angular deviation of the paving screed with respect to the specified reference slope;

means for converting a determined transverse angular deviation of the paving screed with respect to the specified reference slope to a height deviation of one transverse side of the paving screed with respect to the height at the specified reference slope;

means for computing an offsetting angle of change for the angle of attack of the one transverse side of the paving screed as defined by the converted height deviation and a determined interval of advance of the paving screed, and for controlling the paving screed positioning means to apply a correction to the angle of attack on one transverse side of the paving screed with respect to the other based on an offsetting angle of change computed as the converted height deviation over the determined interval of advance of the paving screed.

* * * * *

UNITED STATES PATENT AND TRADEMARK OFFICE

CERTIFICATE OF CORRECTION

PATENT NO. : 5,356,238

DATED : October 18, 1994

INVENTOR(S) : Musil et al.

It is certified that error appears in the above-identified patent and that said Letters Patent is hereby corrected as shown below:

Column 23, Line 1: after "the", delete "hulled" and insert therefor --nulled--

Signed and Sealed this

Seventh Day of February, 1995

*Attest:*

*Attesting Officer*

BRUCE LEHMAN

*Commissioner of Patents and Trademarks*